US012084924B2

(12) United States Patent
Peters et al.

(10) Patent No.: US 12,084,924 B2
(45) Date of Patent: Sep. 10, 2024

(54) DAMPERS FOR MITIGATION OF DOWNHOLE TOOL VIBRATIONS AND VIBRATION ISOLATION DEVICE FOR DOWNHOLE BOTTOM HOLE ASSEMBLY

(71) Applicants: Volker Peters, Wienhausen (DE); Andreas Hohl, Hanover (DE); Dennis Heinisch, Lachendorf (DE); Hanno Reckmann, Nienhagen (DE); Sasa Mihajlovic, Hannover (DE)

(72) Inventors: Volker Peters, Wienhausen (DE); Andreas Hohl, Hanover (DE); Dennis Heinisch, Lachendorf (DE); Hanno Reckmann, Nienhagen (DE); Sasa Mihajlovic, Hannover (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 17/558,722

(22) Filed: Dec. 22, 2021

(65) Prior Publication Data

US 2022/0112775 A1 Apr. 14, 2022

Related U.S. Application Data

(62) Division of application No. 16/353,174, filed on Mar. 14, 2019, now Pat. No. 11,208,853.

(60) Provisional application No. 62/643,385, filed on Mar. 15, 2018, provisional application No. 62/643,291, filed on Mar. 15, 2018.

(51) Int. Cl.
*E21B 17/07* (2006.01)

(52) U.S. Cl.
CPC ..... *E21B 17/07* (2013.01)

(58) Field of Classification Search
CPC ..... E21B 17/07; E21B 17/076; E21B 7/24; E21B 31/005
See application file for complete search history.

(56) References Cited

U.S. PATENT DOCUMENTS 2,585,382 A 2/1952 Guernsey
2,834,225 A 5/1958 Carter et al.
(Continued)

FOREIGN PATENT DOCUMENTS

CN 103939092 A 7/2014
DE 102006001063 A1 1/2007
(Continued)

OTHER PUBLICATIONS

Aiken ID, Nims DK, Whittaker AS, Kelly JM. "Testing of Passive Energy Dissipation Systems". Earthquake Spectra. 1993;9(3):335-370.

(Continued)

*Primary Examiner* — Shane Bomar
(74) *Attorney, Agent, or Firm* — CANTOR COLBURN LLP

(57) ABSTRACT

A system for drilling a borehole into the earth's subsurface includes a drill bit configured to rotate and penetrate through the earth's subsurface, and a vibration isolation device configured to isolate vibration that is caused at the drill bit, the vibration having an amplitude. The amplitude of the vibration downhole of the vibration isolation device is at least 20% higher than the amplitude of the vibration uphole of the vibration isolation device.

20 Claims, 22 Drawing Sheets

(56) References Cited

U.S. PATENT DOCUMENTS 2,903,242 A * 9/1959 Bodine, Jr. ..... E21B 7/24 74/61
2,953,351 A 9/1960 Bodine et al.
2,987,938 A 6/1961 Burch
3,099,918 A 8/1963 Garrett
3,121,347 A 2/1964 Rumsey
3,323,326 A 6/1967 Vertson
3,552,230 A 1/1971 Mclean
3,610,347 A 10/1971 Diamantides et al.
3,768,576 A * 10/1973 Martini ..... E21B 7/24 173/136
3,848,931 A 11/1974 Swisher
3,992,963 A 11/1976 Khanna
4,271,915 A * 6/1981 Bodine ..... E21B 4/02 418/48
4,428,443 A 1/1984 Oliphant
4,502,552 A 3/1985 Martini
4,522,271 A 6/1985 Bodine et al.
4,593,889 A 6/1986 Odobasic
4,619,334 A 10/1986 Gustafsson
4,905,776 A 3/1990 Beynet et al.
5,372,548 A 12/1994 Wohlfeld
5,402,677 A 4/1995 Paslay et al.
5,743,362 A 4/1998 Clinard et al.
6,098,726 A 8/2000 Taylor et al.
6,119,404 A 9/2000 Bschorr et al.
6,158,529 A 12/2000 Dorel
6,327,539 B1 12/2001 Keultjes et al.
6,758,921 B1 7/2004 Streubel et al.
6,785,641 B1 8/2004 Huang
6,808,455 B1 10/2004 Solorenko et al.
7,036,612 B1 5/2006 Raymond et al.
7,219,752 B2 5/2007 Wassell et al.
7,251,590 B2 7/2007 Huang et al.
7,748,474 B2 7/2010 Watkins et al.
7,779,933 B2 8/2010 Sihler et al.
7,828,082 B2 11/2010 Pabon et al.
8,214,188 B2 7/2012 Bailey et al.
8,401,831 B2 3/2013 Tang et al.
8,453,764 B2 6/2013 Turner et al.
8,504,342 B2 8/2013 Bailey et al.
8,589,136 B2 11/2013 Ertas et al.
8,798,978 B2 8/2014 Ertas et al.
8,950,512 B2 2/2015 Nessjoen et al.
8,977,523 B2 3/2015 Ertas et al.
9,004,195 B2 4/2015 Regener et al.
9,109,410 B2 8/2015 Swietlik et al.
9,249,632 B2 2/2016 Lakkashetti et al.
9,382,761 B2 7/2016 Huang et al.
9,458,679 B2 10/2016 Turner et al.
9,476,261 B2 10/2016 Venugopal et al.
9,581,008 B2 2/2017 Kyllingstad
9,677,347 B2 6/2017 Ash et al.
9,976,405 B2 5/2018 Hohl et al.
10,782,197 B2 9/2020 Wu et al.
11,692,404 B2 7/2023 Peters et al.
2003/0062170 A1 4/2003 Slack
2004/0028490 A1 2/2004 Bergholt et al.
2004/0238219 A1 12/2004 Nichols et al.
2005/0145417 A1 7/2005 Radford et al.
2005/0257931 A1* 11/2005 Mody ..... E21B 31/005 166/301
2006/0124354 A1 6/2006 Witte
2006/0278442 A1 12/2006 Kristensen
2007/0289778 A1 12/2007 Watkins
2008/0060849 A1* 3/2008 Entchev ..... E21B 17/07 175/57
2009/0044977 A1 2/2009 Johnson et al.
2010/0025118 A1 2/2010 Hampson et al.
2010/0139977 A1 6/2010 Watkins et al.
2011/0077924 A1 5/2011 Ertas et al.
2011/0120772 A1 5/2011 Mcloughlin et al.
2011/0186353 A1 8/2011 Turner et al.
2011/0198126 A1 8/2011 Swietlik et al.
2011/0245980 A1 10/2011 Nessjoen et al.
2012/0123757 A1 5/2012 Ertas et al.
2012/0130693 A1 5/2012 Ertas et al.
2012/0228028 A1 9/2012 Turner et al.
2012/0241219 A1* 9/2012 Wiercigroch ..... E21B 6/04 175/56
2013/0092439 A1 4/2013 Mauldin et al.
2014/0083772 A1* 3/2014 Wiercigroch ..... E21B 3/04 175/40
2014/0151122 A1 6/2014 Venugopal et al.
2014/0166309 A1 6/2014 Benedict et al.
2014/0284105 A1 9/2014 Veltman
2014/0305660 A1 10/2014 Ash et al.
2014/0318865 A1 10/2014 Doris
2014/0323231 A1 10/2014 Perry
2015/0050083 A1 2/2015 Funderud et al.
2015/0053484 A1 2/2015 Meister et al.
2015/0083493 A1 3/2015 Wassell
2015/0122547 A1 5/2015 Hohl et al.
2015/0259989 A1 9/2015 Gajji et al.
2015/0275648 A1 10/2015 Wang et al.
2016/0002985 A1 1/2016 Baudoin
2016/0138382 A1 5/2016 Badkoubeh et al.
2016/0281488 A1 9/2016 Dwars et al.
2016/0305197 A1 10/2016 Gajji et al.
2016/0356089 A1 12/2016 Nanayakkara et al.
2017/0030149 A1 2/2017 Kadam et al.
2017/0089149 A1 3/2017 Yao et al.
2017/0198840 A1 7/2017 Gabdullin
2017/0328142 A1 11/2017 Pratt et al.
2017/0343046 A1 11/2017 Park et al.
2018/0066488 A1* 3/2018 Wiercigroch ..... B06B 1/10
2018/0100357 A1 4/2018 Christopher et al.
2018/0252054 A1 9/2018 Stokes
2018/0252089 A1 9/2018 Hohl et al.
2018/0371889 A1 12/2018 Hohl et al.
2019/0211882 A1 7/2019 Hauptmann et al.
2019/0284881 A1 9/2019 Hohl et al.
2019/0360320 A1* 11/2019 Hohl ..... E21B 44/02
2020/0018124 A1 1/2020 Hohl
2020/0018377 A1 1/2020 Hohl et al.
2021/0010332 A1 1/2021 Benedict et al.
2021/0079736 A1 3/2021 Reckmann et al.
2021/0079737 A1 3/2021 Peters
2021/0079738 A1 3/2021 Peters et al.
2021/0079976 A1 3/2021 Hohl et al.
2021/0207469 A1 7/2021 Nash et al.
2021/0270120 A1* 9/2021 Hohl ..... E21B 49/003
2023/0009235 A1* 1/2023 Kulke ..... E21B 17/07
2023/0160267 A1* 5/2023 Falahati ..... E21B 47/017 464/20
2023/0193740 A1* 6/2023 Hohl ..... E21B 44/00 175/24
2023/0407712 A1* 12/2023 Reckmann ..... E21B 17/07

FOREIGN PATENT DOCUMENTS

DE 202004021437 U1 3/2008
DE 102017004126 A1 10/2018
WO 2005047640 A2 5/2005
WO 20160007689 A1 1/2016

OTHER PUBLICATIONS

Damptech, "21-001 B comparison between different dampers: Rotational friction damper compared to other dampers", 2017, 4 pages.
Fitzgerald, T.F., Anagnos, T., Goodson, M. and Zsutty, T., (1989). "Slotted bolted connections in aseismic design of concentrically braced connections." Earthquake Spectra, 5(2), 383-391.
Grigorian, C. E., Popov, E. P., "Energy Dissipation with Slotted Bolted Connections", Earthquake Engineering Research Center, College of Engineering, University of California at Berkley, Feb. 1994, 255 pages.
Grigorian, C.E. and Popov, E.P. (1993), "Slotted bolted connections for energy dissipation." Proc. ATC-17-1 Seminar on Seismic Isolation, Passive Energy Dissipation, and Active Control, San Francisco, Mar. 14 pages.

(56) References Cited

OTHER PUBLICATIONS

Hohl, et al.; "Prediction and Mitigation of Torsional Vibrations in Drilling Systems"; IADC/SPE-178874-MS; Mar. 2016, IADC/SPE Drilling Conference and Exhibition; 15 pages.
Hohl, et al; "Derivation and Experimental Validation of an Analytical Criterion for the Identification of Self-Excited Modes in Drilling System"; Journal of Sound and Vibration 342; 2015; 13 pages.
International Search Report and Written Opinion for International Application No. PCT/US2019/022198; International Filing Date Mar. 14, 2019; Report dated Jul. 2, 2019 (pp. 1-10).
International Search Report and Written Opinion for International Application No. PCT/US2020/050419; International Filing Date Sep. 11, 2020; Report dated Dec. 15, 2020 (pp. 1-10).
International Search Report and Written Opinion for International Application No. PCT/US2020/050425; International Filing Date Sep. 11, 2020; Report dated Dec. 21, 2020 (pp. 1-10).
International Search Report and Written Opinion for International Application No. PCT/US2020/050430; International Filing Date Sep. 11, 2020; Report dated Dec. 18, 2020 (pp. 1-8).
International Search Report and Written Opinion for International Application No. PCT/US2020/050475; International Filing Date Sep. 11, 2020; Report dated Dec. 23, 2020 (pp. 1-8).
International Search Report and Written Opinion for International Application No. PCT/US2019/022196; International Filing Date Mar. 14, 2019; Report dated Jul. 2, 2019 (pp. 1-11).
International Search Report and Written Opinion for International Application No. PCT/US2020/049019; International Filing Date Sep. 2, 2020; Report dated Dec. 8, 2020 (pp. 1-12).
Oueslati, et al.; "New Insights Into Drilling Dynamics Through High-Frequency Vibration Measurement and Modeling"; SPE 166212; 2013; Society of Petroleum Engineers; 15 pages.
Aiken, et al. "Testing of Passive Energy Dissipation Systems". Earthquake Spectra. vol. 9, No. 3 (pp. 335-370).
Fitzgerald, et al. "Slotted bolted connections in aseismic design of concentrically braced connections." Earthquake Spectra, vol. 5 No. 2, 1989 (pp. 383-391).
Grigorian, et al. "Energy Dissipation with Slotted Bolted Connections", Earthquake Engineering Research Center, College of Engineering, University of California at Berkley, Feb. 1994, 255 pages.
Grigorian, et al. "Slotted bolted connections for energy dissipation." Proc. ATC-17-1 Seminar on Seismic Isolation, Passive Energy Dissipation, and Active Control, San Francisco, Mar. 1993, 14 pages.
Hohl, et al.; " Derivation and Experimental Validation of an Analytical Criterion for the Identification of Self-Excited Modes in Drilling System"; Journal of Sound and Vibration 342; 2015; pp. 290-302.
Duff, "An Experimental and Computational Investigation of Rotating Flexible Shaft . . . ", Dissertation, Louisiana State University and Agricultural and Mechanical College; 184 pages; Aug. 2013.
J.R. Bailey & S.M. Remmert; "Managing Drilling Vibrations Through BHA Design Optimization"; SPE Drilling & Completion, vol. 25, issue 4; pp. 458-471; (2010); available at https://www.onepetro.org/journal-paper/SPE-139426-PA.
Khulief et al., "Laboratory investigation of drillstring vibrations", Department of Mechanical Engineering, King Fahd University of Petroleum and Minerals, Dhahran, Saudi Arabia; 15 pages; Apr. 28, 2009.
Khulief et al., "Vibration analysis of drillstrings with self-excited stick-slip oscillations", Department of Mechanical Engineering, King Fahd University of Petroleum and Minerals, Dhahran 31261, Saudi Arabia, Oct. 2005, doi:10.1016/j.jsv.2006.06.06.
Notification of Transmittal of the International Search Report and the Written Opinion of the International Searching Authority, or the Declaration: PCT/US2014/063410; dated Feb. 12, 2015; 9 pages.
Sahebkar et al., "Nonlinear vibration analysis of an axially moving drillstring system . . . ", Department of Mechanical Engineering, School of Engineering, Tarbiat Modares University, Tehran; 18 pages; 2011.
Zhu et al.,"Research on the effect of drill string impact on wellbore stability", Journal of Petroleum Science and Engineering, http://dx.doi.org/10.1016/j.petrol.2013.08.004, 30 pages; Aug. 1, 2013.
Eurasian Application No. 202290873 filed Sep. 2, 2020; Eurasian Office Action with English Translation dated May 15, 2023; 5 pages.

* cited by examiner

DAMPERS FOR MITIGATION OF DOWNHOLE TOOL VIBRATIONS AND VIBRATION ISOLATION DEVICE FOR DOWNHOLE BOTTOM HOLE ASSEMBLY

CROSS REFERENCE TO RELATED APPLICATIONS

This application is a Divisional Application of U.S. application Ser. No. 16,353,174 filed on Mar. 14, 2019, which claims the benefit of an earlier filing date from U.S. Provisional Application Ser. No. 62/643,385 and No. 62/643,291, both filed Mar. 15, 2018, the entire disclosures of which are incorporated herein by reference.

BACKGROUND

Field of the Invention

The present invention generally relates to downhole operations and systems for damping vibrations of the downhole systems during operation.

Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation (e.g., a compartment) located below the earth's surface. Different types of tools and instruments may be disposed in the boreholes to perform various tasks and measurements.

In operation, the downhole components may be subject to vibrations that can impact operational efficiencies. For example, severe vibrations in drillstrings and bottomhole assemblies can be caused by cutting forces at the bit or mass imbalances in downhole tools such as mud motors. Impacts from such vibrations can include, but are not limited to, reduced rate of penetration, reduced quality of measurements, and excess fatigue and wear on downhole components, tools, and/or devices.

SUMMARY

Disclosed is a system for drilling a borehole into the earth's subsurface, the system including a drill bit configured to rotate and penetrate through the earth's subsurface, and a vibration isolation device configured to isolate vibration that is caused at the drill bit, the vibration having an amplitude. The amplitude of the vibration downhole of the vibration isolation device is at least 20% higher than the amplitude of the vibration uphole of the vibration isolation device.

Also disclosed is a method for drilling a borehole into the earth's subsurface, the method including rotating and penetrating a drill bit through the earth's subsurface, and isolating vibration that is caused at the drill bit by a vibration isolation device, the vibration having an amplitude. The amplitude of the vibration downhole of the vibration isolation device is at least 20% higher than the amplitude of the vibration uphole of the vibration isolation device.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
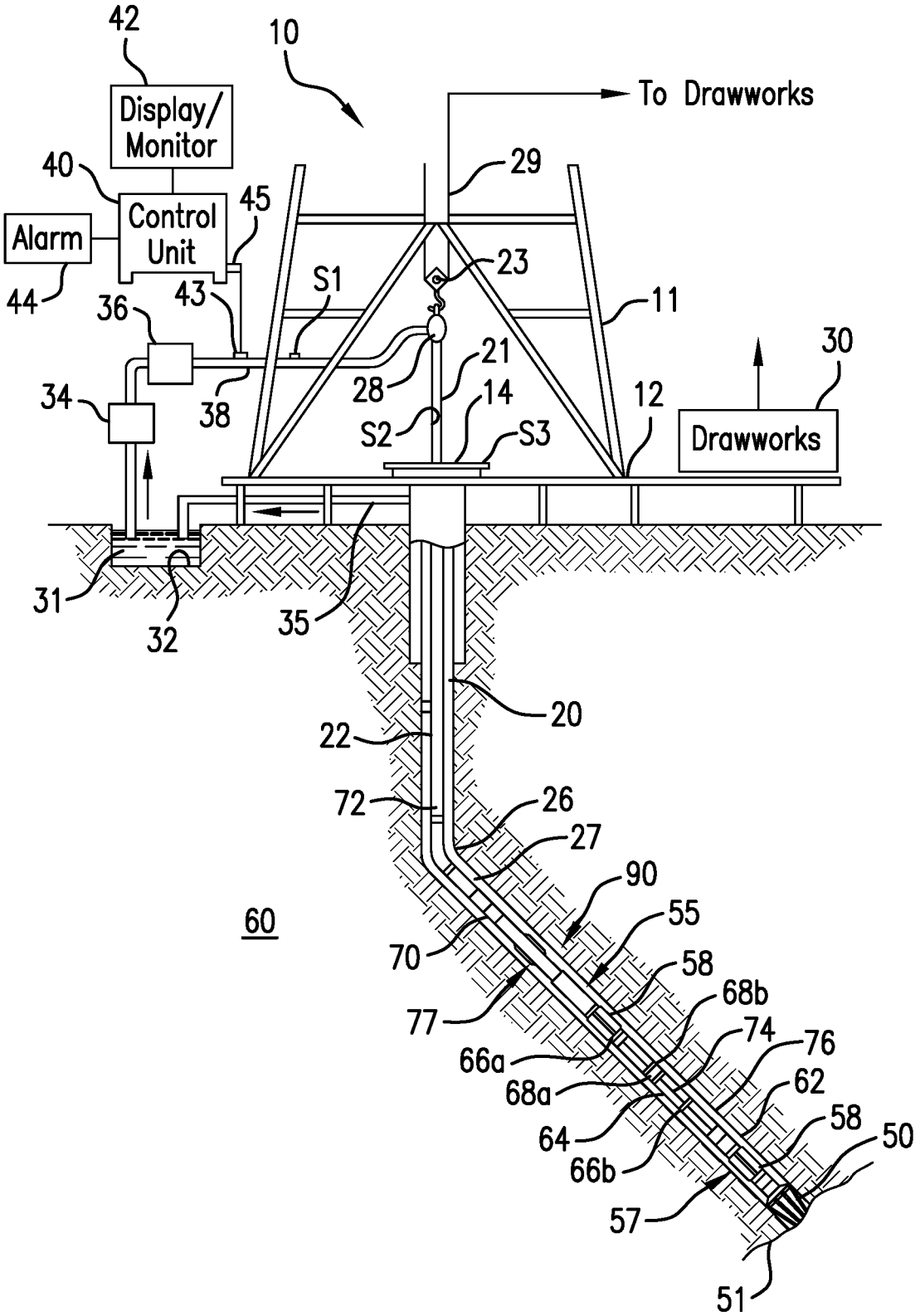
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to surface equipment such as systems for lifting, rotating, and/or pushing, including, but not limited to, a drawworks 30 via a kelly joint 21, swivel 28 and line 29 through a pulley 23. In some embodiments, the surface equipment may include a top drive (not shown). During the drilling operations, the drawworks 30 is operated to control the weight on bit, which affects the rate of penetration. The operation of the drawworks 30 is well known in the art and is thus not described in detail herein.

During drilling operations, a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the fluid line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (for example, a mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the earth formation 60 for a given formation and a given drilling assembly largely depends upon the weight on bit and the drill bit rotational speed. In one aspect of the embodiment of FIG. 1, the drilling motor 55 is coupled to the disintegrating tool 50 via a drive shaft (not shown) disposed in a bearing assembly 57. The drilling motor 55 rotates the disintegrating tool 50 when the drilling fluid 31 passes through the drilling motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and/or other suitable locations act as centralizers for the drilling assembly 90 or portions thereof.

A surface control unit 40 receives signals from the downhole sensors 70 and devices via a transducer 43, such as a pressure transducer, placed in the fluid line 38 as well as from sensors S1, S2, S3, hook load sensors, RPM sensors, torque sensors, and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The surface control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the borehole 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the drilling motor 55 transfers power to the disintegrating tool 50 via a shaft that also enables the drilling fluid to pass from the drilling motor 55 to the disintegrating tool 50. In an alternative embodiment of the drill string 20, the drilling motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, temperature measurement tools, pressure measurement tools, borehole diameter measuring tools (e.g., a caliper), acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the fluid line 38 (e.g., mud supply line) detects the mud pulses responsive to the data transmitted by the downhole telemetry system 72. Transducer 43 generates electrical signals in response to the mud pressure variations and transmits such signals via a conductor 45 to the surface control unit 40. In other aspects, any other suitable telemetry system may be used for two-way data communication (e.g., downlink and uplink) between the surface and the BHA 90, including but not limited to, an acoustic telemetry system, an electro-magnetic telemetry system, an optical telemetry system, a wired pipe telemetry system which may utilize wireless couplers or repeaters in the drill string or the borehole. The wired pipe telemetry system may be made up by joining drill pipe sections, wherein each pipe section includes a data communication link, such as a wire, that runs along the pipe. The data connection between the pipe sections may be made by any suitable method, including but not limited to, hard electrical or optical connections, induction, capacitive, resonant coupling, such as electromagnetic resonant coupling, or directional coupling methods. In case a coiled-tubing is used as the drill pipe 22, the data communication link may be run along a side of the coiled-tubing.

The drilling system described thus far relates to those drilling systems that utilize a drill pipe to convey the drilling assembly 90 into the borehole 26, wherein the weight on bit is controlled from the surface, typically by controlling the operation of the drawworks. However, a large number of the current drilling systems, especially for drilling highly deviated and horizontal boreholes, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the borehole by a suitable injector while the downhole motor, such as drilling motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* and/or receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Borehole, Setting a Liner and Cementing the Borehole. During a Single Trip," which is incorporated herein by reference in its entirety. Importantly, despite a relatively low rate of penetration, the time of getting the liner to target is reduced because the liner is run in-hole while drilling the borehole simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, wired pipe, liner drilling, reaming, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Severe vibrations in drillstrings and bottomhole assemblies during drilling operations can be caused by cutting forces at the bit or mass imbalances in downhole tools such as drilling motors. Such vibrations can result in reduced rate of penetration, reduced quality of measurements made by tools of the bottomhole assembly, and can result in wear, fatigue, and/or failure of downhole components. As appreciated by those of skill in the art, different vibrations exist, such as lateral vibrations, axial vibrations, and torsional vibrations. For example, stick/slip of the whole drilling system and high-frequency torsional oscillations ("HFTO") are both types of torsional vibrations. The terms "vibration," "oscillation," as well as "fluctuation," are used with the same broad meaning of repeated and/or periodic movements or periodic deviations of a mean value, such as a mean position, a mean velocity, and a mean acceleration. In particular, these terms are not meant to be limited to harmonic deviations, but may include all kinds of deviations, such as, but not limited to periodic, harmonic, and statistical deviations. Torsional vibrations may be excited by self-excitation mechanisms that occur due to the interaction of the drill bit or any other cutting structure such as a reamer bit and the formation. The main differentiator between stick/slip and HFTO is the frequency and typical mode shapes: For example, HFTO have a frequency that is typically above 50 Hz compared to stick/slip torsional vibrations that typically have frequencies below 1 Hz. Moreover, the excited mode shape of stick/slip is typically a first mode shape of the whole drilling system whereas the mode shape of HFTO can be of higher order and are commonly localized to smaller portions of the drilling system with comparably high amplitudes at the point of excitation that may be the bit or any other cutting structure (such as a reamer bit), or any contact between the drilling system and the formation (e.g., by a stabilizer).

Due to the high frequency of the vibrations, HFTO correspond to high acceleration and torque values along the BHA. Those skilled in the art will appreciate that for torsional movements, one of acceleration, force, and torque is always accompanied by the other two of acceleration, force, and torque. In that sense, acceleration, force, and torque are equivalent in the sense that none of these can occur without the other two. The loads of high frequency vibrations can have negative impacts on efficiency, reliability, and/or durability of electronic and mechanical parts of the BHA. Embodiments provided herein are directed to providing torsional vibration damping upon the downhole system to mitigate HFTO. In some embodiments of the present disclosure, the torsional vibration damping can be activated if a threshold of a measured property, such as a torsional vibration amplitude or frequency is achieved within the system.

In accordance with a non-limiting embodiment provided herein, a torsional vibration damping system may be based on friction dampers. For example, according to some embodiments, friction between two parts, such as two interacting bodies, in the BHA or drill string can dissipate energy and reduce the level of torsional oscillations, thus mitigating the potential damage caused by high frequency vibrations. Preferably, the energy dissipation of the friction damper is at least equal to the HFTO energy input caused by the bit-rock interaction.

Friction dampers, as provided herein, can lead to a significant energy dissipation and thus mitigation of torsional vibrations. When two components or interacting bodies are in contact with each other and move relative to each other, a friction force acts in the opposite direction of the velocity of the relative movement between the contacting surfaces of the components or interacting bodies. The friction force leads to a dissipation of energy.

Figure 2:
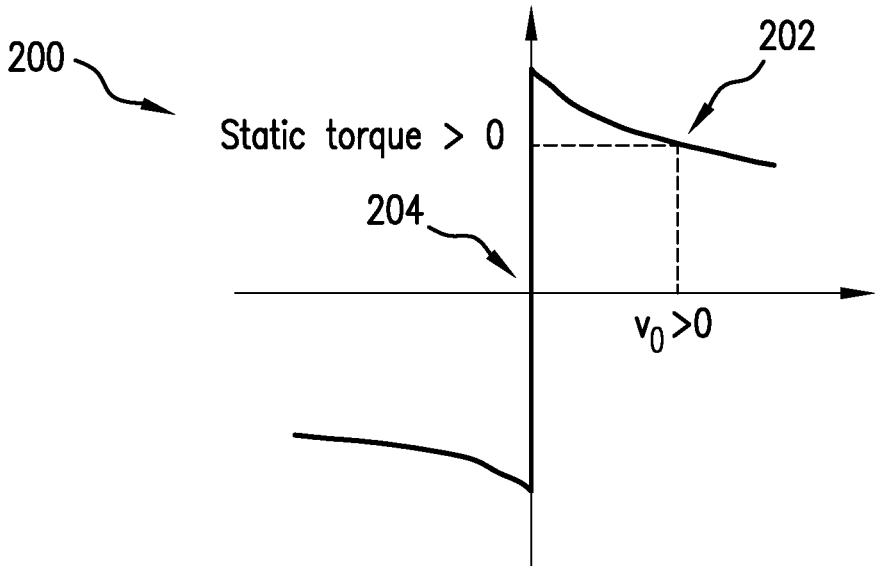
FIG. 2 is an illustrative plot of a typical curve of frictional force or torque versus relative velocity or relative rotational speed between two interacting bodies.

FIG. 2 is an illustrative plot 200 of a typical curve of the friction force or torque versus relative velocity v (e.g., or relative rotational speed) between two interacting bodies. The two interacting bodies have a contact surface and a force component $F_N$ perpendicular to the contact surface engaging the two interacting bodies. Plot 200 illustrates the dependency of friction force or torque of the two interacting bodies with a velocity-weakening frictional behavior. At higher relative velocities ($v>0$) between the two interacting bodies, the friction force or torque has a distinct value, illustrated by point 202. Decreasing the relative velocity will lead to an increasing friction force or torque (also referred to as velocity-weakening characteristic). The friction force or torque reaches its maximum when the relative velocity is zero. The maximum friction force is also known as static friction, sticking friction, or stiction.

Generally, friction force $F_R$ depends on the normal force as described in the equation $F_R=\mu \cdot F_N$, with friction coefficient Generally, the friction coefficient $\mu$ is a function of velocity. In the case that the relative speed between two interacting bodies is zero ($v=0$), the static friction force $F_S$ is related to the normal force component $F_N$ by the equation $F_S=\mu_0 \cdot F_N$ with the static friction coefficient $\mu_0$. In the case that the relative speed between the two interacting bodies is not zero ($v\neq 0$), the friction coefficient is known as dynamic friction coefficient $\mu$. If the relative velocity is further decreased to negative values (i.e., if the direction the relative movement of the two interacting bodies is switched to the opposite), the friction force or torque switches to the opposite direction with a high absolute value corresponding to a step from a positive maximum to a negative minimum at point 204 in plot 200. That is, the friction force versus velocity shows a sign change at the point where the velocity changes the sign and is discontinuous at point 204 in plot 200. Velocity-weakening characteristic is a well-known effect between interacting bodies that are frictionally connected. The velocity-weakening characteristic of the contact force or torque is assumed to be a potential root cause for stick/slip. Velocity-weakening characteristic may also be achieved by utilizing dispersive fluid with a higher viscosity at lower relative velocities and a lower viscosity at higher relative velocities. If a dispersive fluid is forced through a relatively small channel, the same effect can be achieved in that the flow resistance is relatively high or low at low or high relative velocities, respectively.

Figure 8A:
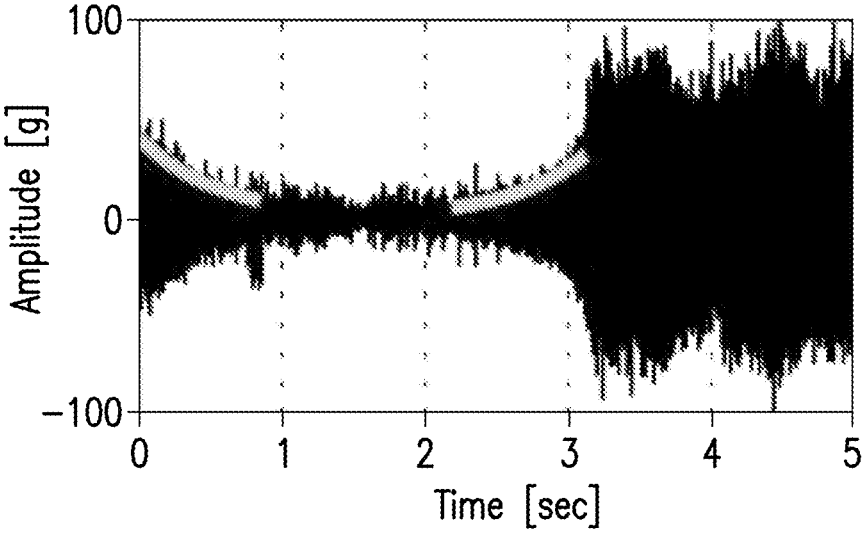
FIG. 8A is a plot of tangential acceleration measured at a bit.
Figure 8B:
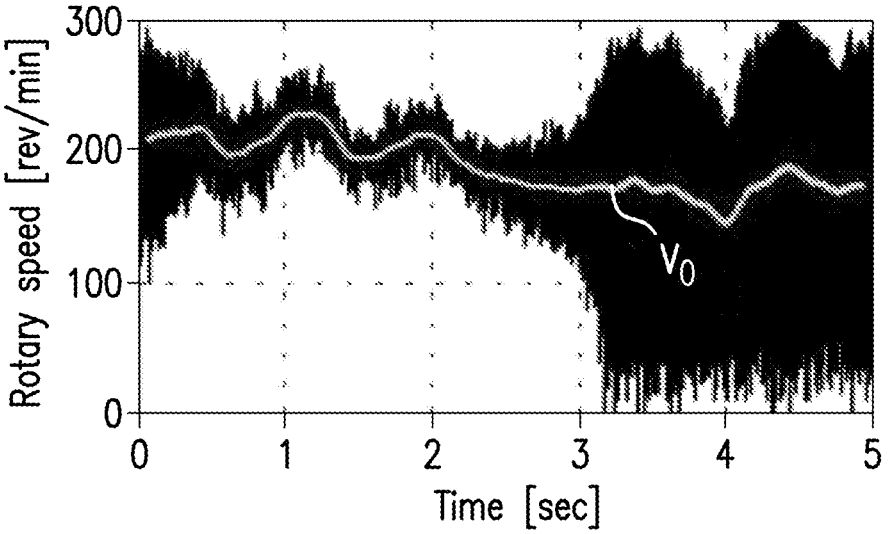
FIG. 8B is a plot corresponding to FIG. 8A illustrating rotary speed.

With reference to FIGS. 8A-8B, FIG. 8A illustrates measured torsional acceleration of a downhole system versus time. In the 5 second measurement time shown in FIG. 8A, FIG. 8A shows oscillating torsional acceleration with a mean acceleration of approximately 0 g, overlayed by oscillating torsional accelerations with a relatively low amplitude between approximately 0 s and 3 s and relatively high amplitudes up to 100 g between approximately 3 s and 5 s. FIG. 8B illustrates the corresponding rotary velocity in the same time period as in FIG. 8A. In accordance with FIG. 8A, FIG. 8B illustrates a mean velocity $v_0$ (indicated by the line $v_0$ in FIG. 8B) which is relatively constant at approximately 190 rev/min. The mean velocity is overlayed by oscillating rotary velocity variations with relatively low amplitudes between approximately 0 s and 3 s and relatively high amplitudes between approximately 3 s and 5 s in accordance with the relatively low and high acceleration amplitudes in FIG. 8A. Notably, the oscillating rotary speed does not lead to negative values of the rotary velocity, even not in the time period between approximately 3 s and 5 s when the amplitudes of the rotary speed oscillations are relatively high.

Referring again to FIG. 2, point 202 illustrates a mean velocity of the two interacting bodies that is according to the mean velocity $v_0$ in FIG. 8B. In the schematic illustration of FIG. 2, the data of FIG. 8B corresponds to a point with a velocity oscillating with relatively high frequency due to HTFO around the mean velocity $v_0$ that varies relatively slowly with time compared to the HFTO. The point illustrating the data of FIG. 8B therefore moves back and forth on the positive branch of the curve in FIG. 2 without or only rarely reaching negative velocity values. Accordingly, the corresponding friction force or torque oscillates around a positive mean friction force or mean friction torque and is generally positive or only rarely reaches negative values. As discussed further below, the point 202 illustrates where a positive mean value of the relative velocity corresponds to a static torque and the point 204 illustrates a favorable point for friction damping. It is noted that friction forces or torque between the drilling system and the borehole wall will not generate additional damping of high frequency oscillations in the system. This is because the relative velocity between the contact surfaces of the interacting bodies (e.g., a stabilizer and the borehole wall) does not have a mean velocity that is so close to zero that the HFTO lead to a sign change of the relative velocity of the two interacting bodies. Rather, the relative velocity between the two interacting bodies has a high mean value at a distance from zero that is large so that the HFTO do not lead to a sign change of the relative velocity of the two interacting bodies (e.g., illustrated by point 202 in FIG. 2).

As will be appreciated by those of skill in the art, the weakening characteristic of the contact force or torque with respect to the relative velocity as illustrated in FIG. 2, leads to an application of energy into the system for oscillating relative movements of the interacting bodies with a mean velocity $v_0$ that is high compared to the velocity of the oscillating movement. In this context, other examples of self-excitation mechanisms such as coupling between axial and torsional degree of freedom could lead to a similar characteristic.

Figure 3:
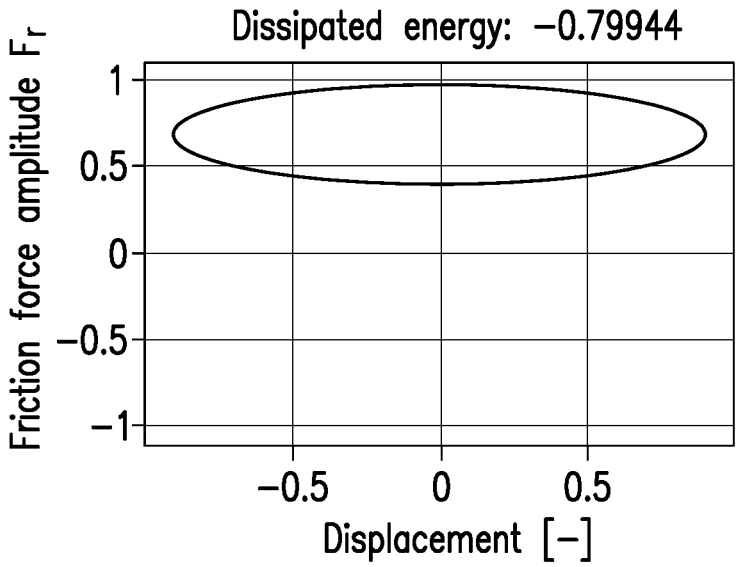
FIG. 3 is a hysteresis plot of a friction force versus displacement for a positive relative mean velocity with additional small velocity fluctuations.
Figure 4:
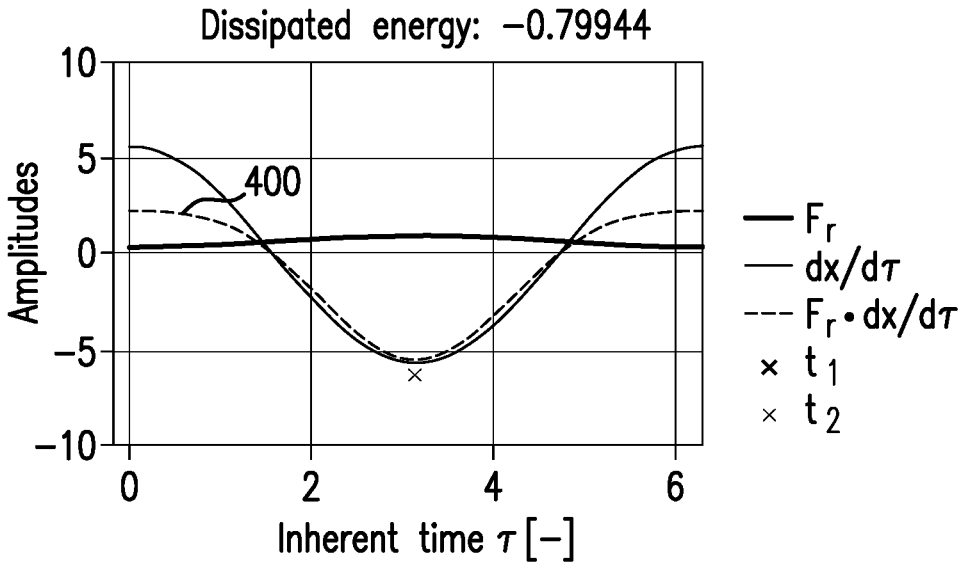
FIG. 4 is a plot of friction force, relative velocity, and product of both for a positive relative mean velocity with additional small velocity fluctuations.

The corresponding hysteresis is depicted in FIG. 3 and the time plot for the friction force and velocity is shown in FIG. 4. FIG. 3 illustrates hysteresis of a friction force $F_r$, sometimes also referred to as a cutting force in this context, versus displacement relative to a location that is moving with a positive mean relative velocity with additional small velocity fluctuations leading to additional small displacement dx. Accordingly, FIG. 4 illustrates the friction force ($F_r$), relative velocity $$\left(\frac{dx}{d\tau}\right),$$

and a product of both (indicated by label 400 in FIG. 4) for a positive mean relative velocity with additional small velocity fluctuations leading to additional small displacement dx. Those skilled in the art, will appreciate that the area between the friction force and the velocity over time is equal to the dissipated energy (i.e., the area between the line 400 and the zero axis), which is negative in the case that is illustrated by FIG. 3 and FIG. 4. That is, in the case illustrated by FIGS. 3 and 4, energy is transferred into the oscillation from the friction via the frictional contact.

Figure 5:
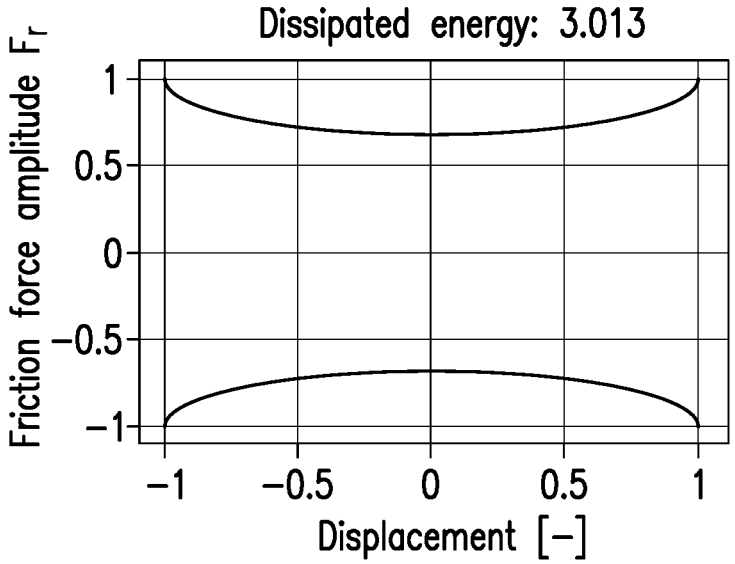
FIG. 5 is a hysteresis plot of a friction force versus displacement for a relative mean velocity of zero with additional small velocity fluctuations.
Figure 6:
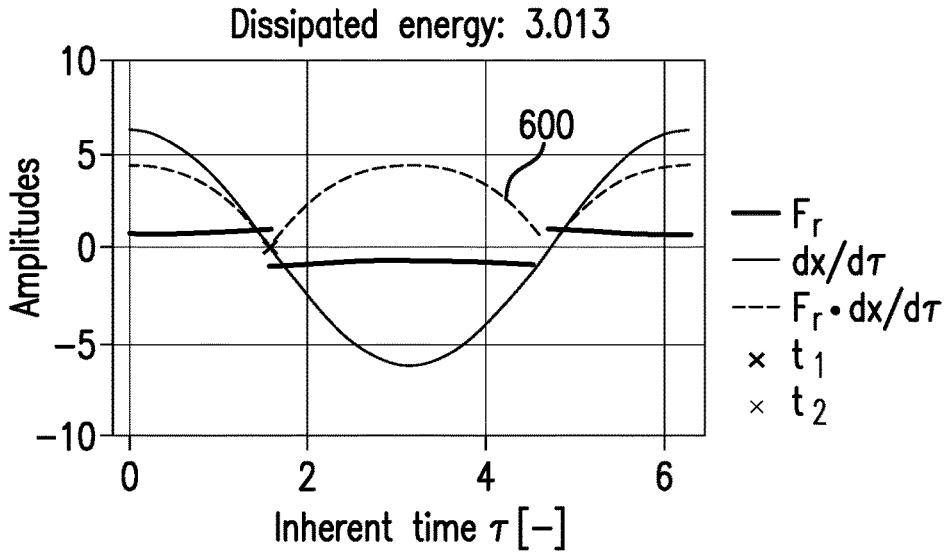
FIG. 6 is a plot of friction force, relative velocity, and a product of both for a relative mean velocity of zero with additional small velocity fluctuations.

Referring again to FIG. 2, the point 204 denotes the favorable mean velocity for friction damping of small velocity fluctuations or vibrations in addition to the mean velocity. For small fluctuations of the relative movement between the two interacting bodies, the discontinuity at point 204 in FIG. 2 with the sign change of the relative velocity of the interacting bodies also leads to an abrupt sign change of the friction force or torque. This sign change leads to a hysteresis that leads to a large amount of dissipated energy. For example, compare FIGS. 5 and 6, which are similar plots to FIGS. 3 and 4, respectively, but illustrate the case of zero mean relative velocity with additional small velocity fluctuations or vibrations. The area below the line 600 in FIG. 6 that corresponds to the product $F_r \cdot dx/d\tau$ is equal to the dissipated energy during one period and is, in this case, positive. That is, in the case illustrated by FIGS. 5 and 6, the energy is transferred from the high frequency oscillation via the frictional contact into the friction. The effect is comparably high compared to the case illustrated by FIGS. 3 and 4 and has the desired sign. It is also clear from the comparison of FIGS. 2, 5, and 6 that the dissipated energy significantly depends on the difference between maximum friction force and minimum friction force for v=0 (i.e., location 204 in FIG. 2). The higher the difference between maximum friction force and minimum friction force for v=0, the higher is the dissipated energy. While FIGS. 3-4 were generated by using a velocity weakening characteristics, such as the one shown in FIG. 2, embodiments of the present disclosure are not limited to such type of characteristics. The apparatuses and methods disclosed herein will be functional for any type of characteristic provided that the friction force or torque undergoes a step with a sign change when the relative velocity between the two interacting bodies changes its sign.

Friction dampers in accordance with some embodiments of the present disclosure will now be described. The friction dampers are installed on or in a drilling system, such as drilling system 10 shown in FIG. 1, and/or are part of drilling system 10, such as part of the bottomhole assembly 90. The friction dampers are part of friction damping systems with two interacting bodies, such as a first element and a second element having a frictional contact surface with the first element. The friction damping systems of the present disclosure are arranged so that the first element has a mean velocity that is related to the rotary speed of the drilling system to which it is installed. For example, the first element may have a similar or the same mean velocity or rotary speed as the drilling system, so that small fluctuating oscillations lead to a sign change or zero crossing of the relative velocity between the first element and second element according to point 204 in FIG. 2. It is noted that friction forces or torque between the drilling system and the borehole wall will not generate additional damping of high frequency oscillations in the system. This is because the relative velocity between the contact surfaces (e.g., a stabilizer and the borehole) does not have a zero mean value (e.g., point 202 in FIG. 2). In accordance with embodiments described herein, the static friction between the first element and the second element are set to be high enough to enable the first element to accelerate the second element (during rotation) to a mean velocity $v_0$ with the same value as the drilling system. Additional high frequency oscillations, therefore, introduce slipping between the first element (e.g., damping device) and the second element (e.g., drilling system) with positive or negative velocities according to oscillations around a position in FIG. 2 that is equal to or close to point 204 in FIG. 2. Slipping occurs if the inertial force $F_1$ exceeds the static friction force, expressed as the static friction coefficient multiplied by the normal force between the two interacting bodies: $F_1 > \mu_0 \cdot F_N$. In accordance with embodiments of the present disclosure, the normal force $F_N$ (e.g. caused by the contact and surface pressure of the contact surface between the two interacting bodies) and the static friction coefficient $\mu_0$ are adjusted to achieve an optimal energy dissipation. Further, the moment of inertia (torsional), the contact and surface pressure of the contacting surfaces, and the placement of the damper or contact surface with respect to the distance from bit may be optimized.

Figure 7:
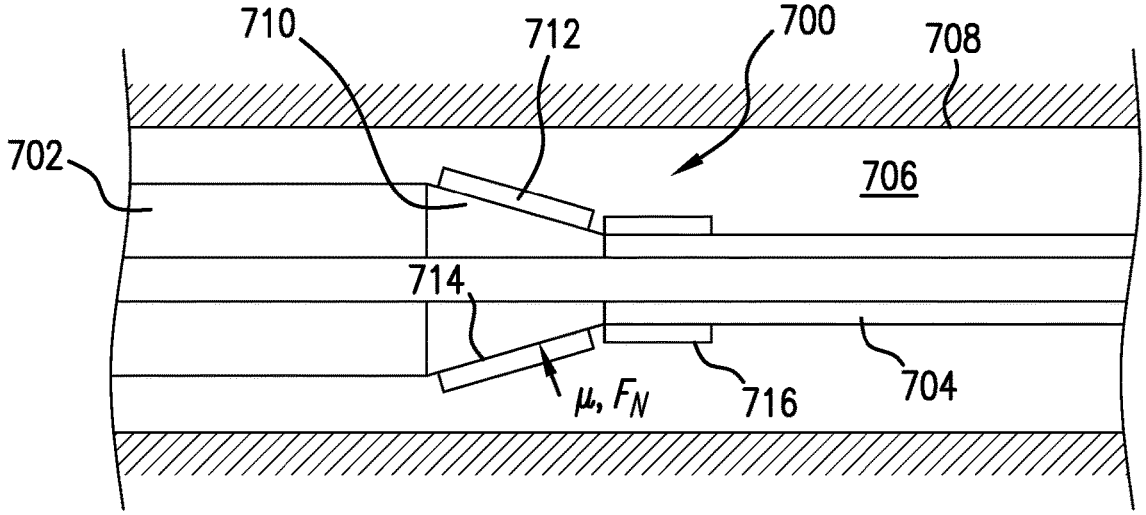
FIG. 7 is a schematic illustration of a damping system in accordance with an embodiment of the present disclosure.

For example, turning to FIG. 7, a schematic illustration of a damping system 700 in accordance with an embodiment of the present disclosure is shown. The damping system 700 is part of a downhole system 702, such as a bottomhole assembly and/or a drilling assembly. The downhole system 702 includes a string 704 that is rotated to enable a drilling operation of the downhole system 702 to form a borehole 706 within a formation 708. As discussed above, the borehole 706 is typically filled with drilling fluid, such as drilling mud. The damping system 700 includes a first element 710 that is operatively coupled, e.g. fixedly connected or an integral part of the downhole system 702, so as to ensure that the first element 710 rotates with a mean velocity that is related to, e.g. similar to or same as the mean velocity of the downhole system 702. The first element 710 is in frictional contact with a second element 712. The second element 712 is at least partially movably mounted on the downhole system 702, with a contact surface 714 located between the first element 710 and the second element 712.

In the case of frictional forces, the difference between the minimum and maximum friction force is positively dependent on the normal force and the static friction coefficient. The dissipated energy increases with friction force and the harmonic displacement, but, only in a slip phase, energy is dissipated. In a sticking phase, the relative displacement between the friction interfaces and the dissipated energy is zero. The upper amplitude limit of the sticking phase increases linearly with the normal force and the friction coefficient in the contact interface. The reason is that the reactive force in the contact interface, $J\ddot{x} \geq M_H = F_N \mu_H r$, that can be caused by the inertia J of one of the contacting bodies if it is accelerated with z has to be higher than the torque $M_H = F_N \mu_H r$ that defines the limit between sticking and slipping. As used herein, $F_N$ is the normal force and $\mu_H$ is the effective friction coefficient and r is the effective or mean radius of the friction contact area.

Similar mechanisms apply if the contact force is caused by a displacement and spring element. The acceleration z of the contact area can be due to an excitation of a mode and is dependent upon the corresponding mode shape, as further discussed below with respect to FIG. 9B. In case of an attached inertia mass J the acceleration is equal to the acceleration of the excited mode and corresponding mode shape at the attachment position as long as the contact interface is sticking.

The normal force and friction force have to be adjusted to guarantee a slipping phase in an adequate or tolerated amplitude range. A tolerated amplitude range can be defined by an amplitude that is between zero and the limits of loads that are, for example, given by design specifications of tools and components. A limit could also be given by a percentage of the expected amplitude without the damper. The dissipated energy that can be compared to the energy input, e.g., by a forced or self-excitation, is one measure to judge the efficiency of a damper. Another measure is the provided equivalent damping of the system that is proportional to the ratio of the dissipated energy in one period of a harmonic vibration to the potential energy during one period of vibration in the system. This measure is especially effective in case of self-excited systems. In the case of self-excited systems, the excitation can be approximated by a negative damping coefficient and both the equivalent damping and the negative damping can be directly compared. The damping force that is provided by the damper is nonlinear and strongly amplitude dependent.

Figure 20:
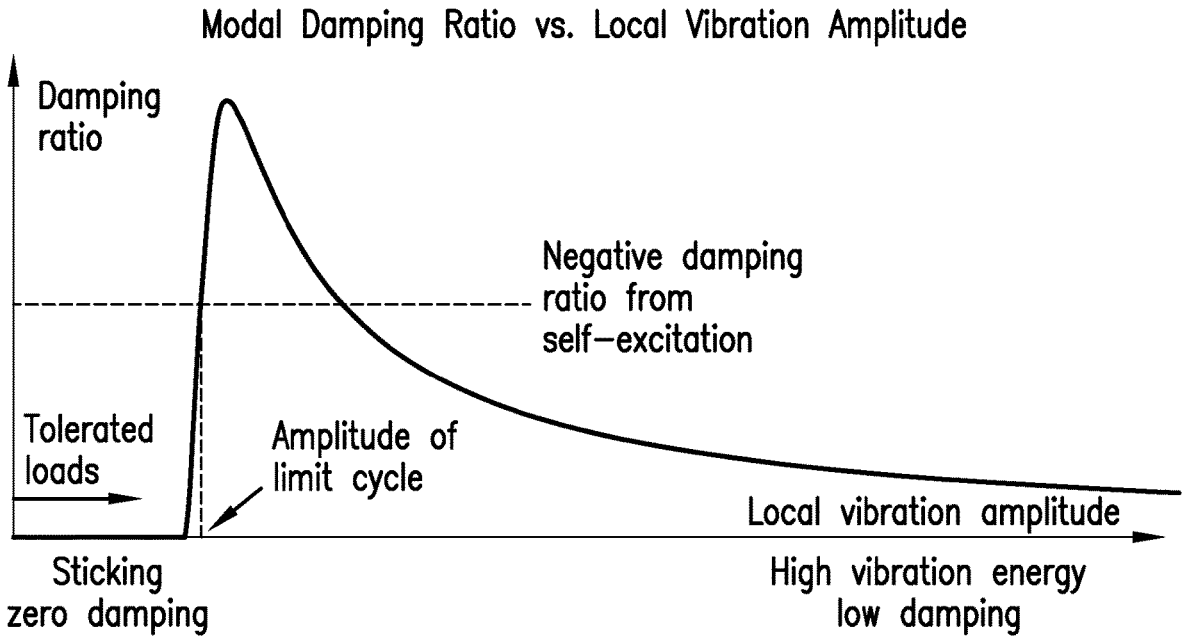
FIG. 20 is a schematic plot of a modal damping ratio versus local vibration amplitude.

As shown in FIG. 20, the damping is zero in the sticking phase (left end of plot of FIG. 20) where the relative movement between the interacting bodies is zero. If, as described above, the limit between the sticking and slipping phase is exceeded by the force that is transferred through the contact interface, a relative sliding motion is occurring that causes the energy dissipation. The damping ratio provided by the friction damping is then increasing to a maximum and afterwards declining to a minimum. The amplitude that will be occurring is dependent upon the excitation that could be described by the negative damping term. Herein, the maximum of the damping provided, as depicted in FIG. 20, has to be higher than the negative damping from the self-excitation mechanism. The amplitude that is occurring in a so-called limit cycle can be determined by the intersection of the negative damping ratio and the equivalent damping ratio that is provided by the friction damper.

The curve is dependent on different parameters. It is beneficial to have a high normal force but a sliding phase with as low an amplitude as possible. In the case of the inertia mass, this can be achieved by a high mass or by placing the contact interface at a point of high acceleration. In the case of contacting interfaces, a high relative displacement in comparison to the amplitude of the mode is beneficial. Therefore, an optimal placement of the damping device according to a high amplitude or relative amplitude is important. This can be achieved by using simulation results, as discussed below. The normal force and the friction coefficient can be used to shift the curve to lower or higher amplitudes but does not have a high influence on the damping maximum. If more than one friction damper is implemented, this would lead to a superposition of similar curves shown in FIG. 20. If the normal force and friction coefficients are adjusted to achieve the maximum at the same amplitude, this is beneficial for the overall damping that is achieved. Further, slightly shifted damping curves would lead to a resulting curve that could be broader with respect to the amplitude that could be beneficial to account for impacts that could shift the amplitude to the right of the maximum. In this case, the amplitude would increase to a very high value in case of self-excited systems as indicated by the negative damping. In this case, the amplitude needs to be shifted again to the left side of the maximum, e.g., by going off bottom or reducing the rotary speed of the system to lower levels.

Referring again to FIG. 7, the string 704, and thus the downhole system 702, rotates with a rotary speed $d\varphi/d\tau$, that may be measured in revolutions per minute (RPM). The second element 712 is mounted onto the first element 710. A normal force $F_N$ between the first element 710 and the second element 712 can be selected or adjusted through application and use of an adjusting element 716. The adjusting element 716 may be adjustable, for example via a thread, an actuator, a piezoelectric actuator, a hydraulic actuator, and/or a spring element, to apply force that has a component in the direction perpendicular to the contact surface 714 between the first element 710 and the second element 712. For example, as shown in FIG. 7, the adjusting element 716 may apply a force in axial direction of downhole system 702, that translates into a force component $F_N$ that is perpendicular to the contact surface 714 of first element 710 and second element 712 due to the non-zero angle between the axis of the downhole system 702 and the contact surface 714 of first element 710 and second element 712.

The second element 712 has a moment of inertia J. When HFTO occurs during operation of the downhole system 702, both the downhole system 702 and the second element 712 are accelerated according to a mode shape. Exemplary results of such operation are shown in FIGS. 8A and 8B. FIG. 8A is a plot of tangential acceleration measured at a bit and FIG. 8B is a corresponding rotary speed.

Due to the tangential acceleration and the inertia of the second element 712, relative inertial forces occur between the second element 712 and the first element 710. If these inertial forces exceed a threshold between sticking and slipping, i.e., if these inertial forces exceed static friction force between the first element 710 and the second element 710, a relative movement between the elements 710, 712 will occur that leads to energy dissipation. In such arrangements, the accelerations, the static and/or dynamic friction coefficient, and the normal force determine the amount of dissipated energy. For example, the moment of inertia J of the second element 712 determines the relative force that has to be transferred between the first element 710 and the second element 712. High accelerations and moments of inertia increase the tendency for slipping at the contact surface 714 and thus lead to a higher energy dissipation and equivalent damping ratio provided by the damper.

Due to the energy dissipation that is caused by frictional movement between the first element 710 and the second element 712, heat and wear will be generated on the first element 710 and/or the second element 712. To keep the wear below an acceptable level, materials can be used for the first and/or second elements 710, 712 that can withstand the wear. For example, diamonds or polycrystalline diamond compacts can be used for, at least, a portion of the first and/or second elements 710, 712. Alternatively, or in addition, coatings may help to reduce the wear due to the friction between the first and second elements 710, 712. The heat can lead to high temperatures and may impact reliability or durability of the first element 710, the second element 712, and/or other parts of the downhole system 702. The first element 710 and/or the second element 712 may be made of a material with high thermal conductivity or high heat capacity and/or may be in contact with a material with high thermal conductivity or heat capacity.

Such materials with high thermal conductivity include, but are not limited to, metals or compounds including metal, such as copper, silver, gold, aluminum, molybdenum, tungsten or thermal grease comprising fat, grease, oil, epoxies, silicones, urethanes, and acrylates, and optionally fillers such as diamond, metal, or chemical compounds including metal (e.g., silver, aluminum in aluminum nitride, boron in boron nitride, zinc in zinc oxide), or silicon or chemical compounds including silicon (e.g., silicon carbide). In addition or alternatively, one or both of the first element 710 and the second element 712 may be in contact with a flowing fluid, such as the drilling fluid, that is configured to remove heat from the first element 710 and/or the second element 712 in order to cool the respective element 710, 712. Further, an amplitude limiting element (not shown), such as a key, a recess, or a spring element may be employed and configured to limit the energy dissipation to an acceptable limit that reduces the wear. When arranging the damping system 700, a high normal force and/or static or dynamic friction coefficient will prevent a relative slipping motion between the first element 710 and the second element 712, and in such situations, no energy will be dissipated. In contrast, a low normal force and/or static or dynamic friction coefficient can lead to a low friction force, and slipping will occur but the dissipated energy is low. In addition, low normal force and/or static or dynamic friction coefficient may lead to the case that the friction at the outer surface of the second element 712, e.g., between the second element 712 and the formation 708, is higher than the friction between first element 710 and second element 712, thus leading to the situation that the relative velocity between first element 710 and second element 712 is not equal to or close to zero but is in the range of the mean velocity between downhole system 702 and formation 708. As such, the normal force and the static or dynamic friction coefficient may be adjusted (e.g., by using the adjusting element 716) to achieve an optimized value for energy dissipation.

This can be done by adjusting the normal force $F_N$, the static friction coefficient $\mu_0$, the dynamic friction coefficient $\mu$, or combinations thereof. The normal force $F_N$ can be adjusted by positioning the adjusting element 716 and/or by actuators that generate a force on one of the first and second elements with a component perpendicular to the contact surface of first and second element, by adjusting the pressure regime around first and second element, or by increasing or decreasing an area where a pressure is acting on. For example, by increasing the outer pressure that acts on the second element, such as the mud pressure, the normal force $F_N$ will be increased as well. Adjusting the pressure of the mud downhole may be achieved by adjusting the mud pumps (e.g., mud pumps 34 shown in FIG. 1) on surface or other equipment on surface or downhole that influences the mud pressure, such as bypasses, valves, desurgers.

The normal force $F_N$ may also be adjusted by a biasing element (not shown), such as a spring element, that applies force on the second element 712, e.g. a force in an axial direction away from or toward the first element 710. Adjusting the normal force $F_N$ may also be done in a controlled way based on an input received from a sensor. For example, a suitable sensor (not shown) may provide one or more parameter values to a controller (not shown), the parameter value(s) being related to the relative movement of the first element 710 and the second element 712 or the temperature of one or both of the first element 710 and the second element 712. Based on the parameter value(s), the controller may provide instruction to increase or decrease the normal force $F_N$. For example, if the temperature of one or both of the first element 710 and the second element 712 exceeds a threshold temperature, the controller may provide instruction to decrease the normal force $F_N$ to prevent damage to one or both of the first element 710 and the second element 712 due to high temperatures. Similarly, for example, if a distance, velocity, or acceleration of the second element 712 relative to the first element 710 exceeds a threshold, the controller may provide instructions to increase or decrease the normal force $F_N$ to ensure optimal energy dissipation. By monitoring the parameter value, the normal force $F_N$ may be controlled to achieve desired results over a time period. For instance, the normal force $F_N$ may be controlled to provide optimal energy dissipation while keeping the temperature of one or both of the first element 710 and the second element 712 below a threshold for a drilling run or a portion thereof.

Additionally, the static or dynamic friction coefficient can be adjusted by utilizing different materials, for example, without limitation, material with different stiffness, different roughness, and/or different lubrication. For example, a surface with higher roughness often increases the friction coefficient. Thus, the friction coefficient can be adjusted by choosing a material with an appropriate friction coefficient for at least one of the first and the second element or a part of at least one of the first and second element. The material of first and/or second element may also have an effect on the wear of the first and second element. To keep the wear low of the first and second element it is beneficial to choose a material that can withstand the friction that is created between the first and second elements. The inertia, the friction coefficient, and the expected acceleration amplitudes (e.g., as a function of mode shape and eigenfrequency) of the second element 712 are parameters that determine the dissipated energy and also need to be optimized. The critical mode shapes and acceleration amplitudes can be determined from measurements or calculations or based on other known methods as will be appreciated by those of skill in the art. Examples are a finite element analysis or the transfer matrix method or finite differences method and based on this a modal analysis. The placement of the friction damper is optimal where a high relative displacement or acceleration is expected.

Figure 9A:
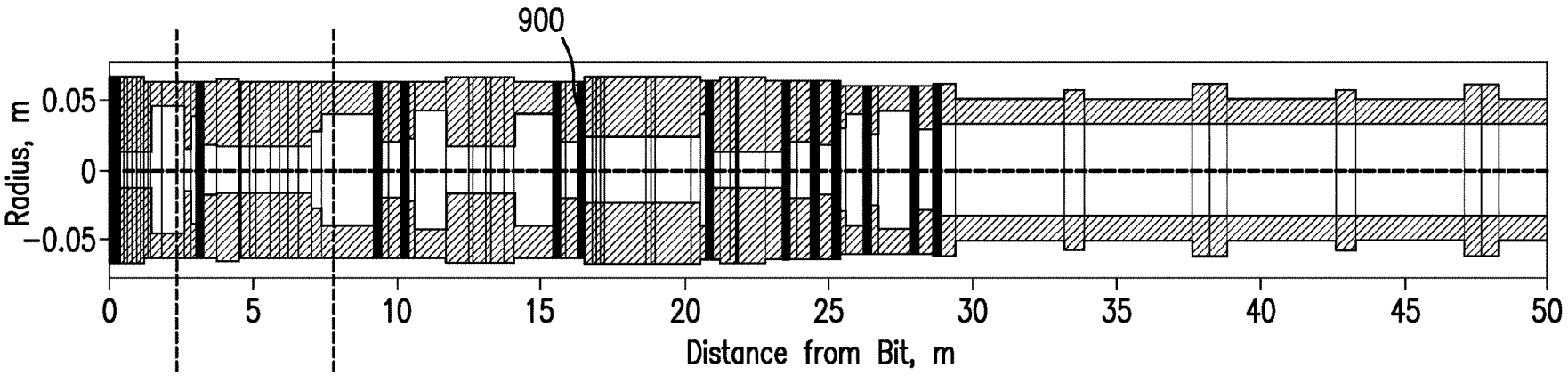
FIG. 9A is a schematic plot of a downhole system illustrating a shape of a downhole system as a function of distance-from-bit.
Figure 9B:
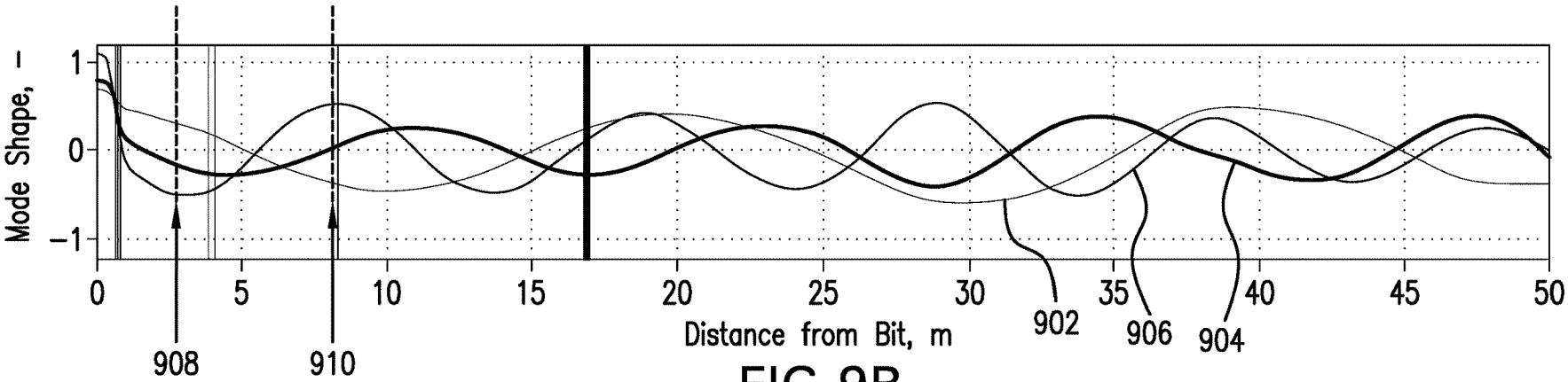
FIG. 9B illustrates example corresponding mode shapes of torsional vibrations that may be excited during operation of the downhole system of FIG. 9A.

Turning now to FIGS. 9A and 9B, an example of a downhole system 900 and corresponding modes are shown. FIG. 9A is a schematic plot of a downhole system illustrating a shape of a downhole system as a function of distance-from-bit, and FIG. 9B illustrates example corresponding mode shapes of torsional oscillations that may be excited during operation of the downhole system of FIG. 9A. The illustrations of FIGS. 9A and 9B demonstrate the potential location and placement of one or more elements of a damping system onto the downhole system 900.

As illustratively shown in FIG. 9A, the downhole system 900 has various components with different diameters (along with differing masses, densities, configurations, etc.) and thus during rotation of the downhole system 900, different components may cause various modes to be generated. The illustrative modes indicate where the highest amplitudes will exist that may require damping by application of a damping system. For example, as shown in FIG. 9B, the mode shape 902 of a first torsional oscillation, the mode shape 904 of a second torsional oscillation, and the mode shape 906 of a third torsional oscillation of the downhole system 900 are shown. Based on the knowledge of mode shapes 902, 904, 906, the position of the first elements of damping system can be optimized. Where an amplitude of a mode shape 902, 904, 906 is maximum (peaks), damping may be required and/or achieved. Accordingly, illustratively shown are two potential locations for attachment or installation of a damping system of the present disclosure.

For example, a first damping location 908 is close to the bit of downhole system 900 and mainly damps the first and third torsional oscillations (corresponding to mode shapes 902, 906) and provides some damping with respect to the second torsional oscillation (corresponding to mode shape 904). That is, the first damping location 908 to be approximately at a peak of the third torsional oscillation (corresponding to mode shape 906), close to peak of the first torsional oscillation mode shape 902, and about half-way to peak with respect to the second torsional oscillation mode shape 904.

A second damping location 910 is arranged to again mainly provide damping of the third torsional oscillation mode shape 906 and provide some damping with respect to the first torsional oscillation mode shape 902. However, in the second damping location 910, no damping of the second torsional oscillation mode shape 904 will occur because the second torsional oscillation mode shape 904 is nearly zero at the second damping location 910.

Although only two locations are shown in FIGS. 9A and 9B for placement of damping systems of the present disclosure, embodiments are not to be so limited. For example, any number and any placement of damping systems may be installed along a downhole system to provide torsional vibration damping upon the downhole system. An example of a preferred installation location for a damper is where one or more of the expected mode shapes show high amplitudes.

Due to the high amplitudes at the drill bit, for example, one good location of a damper is close to or even within the drill bit. Further, the first and second elements are not limited to a single body, but can take any number of various configurations to achieve desired damping. That is, multiple body (multi-body) first or second elements (e.g., friction damping devices) with each body having the same or different normal forces, friction coefficients, and moments of inertia can be employed. Such multiple-body element arrangements can be used, for example, if it is uncertain which mode shape and corresponding acceleration is expected at a given position along a downhole system.

Figure 10:
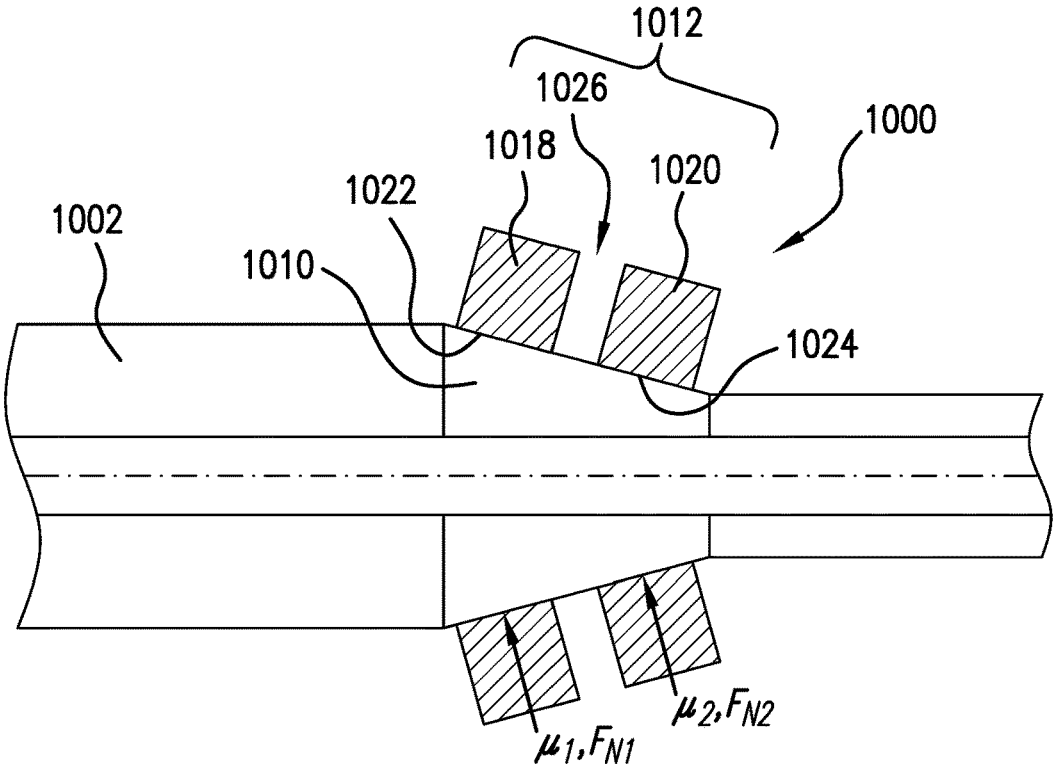
FIG. 10 is a schematic illustration of a damping system in accordance with an embodiment of the present disclosure.

For example, two or more element bodies that can achieve different relative slipping motion between each other to dissipate energy may be used. The multiple bodies of the first element can be selected and assembled with different static or dynamic friction coefficients, angles between the contact surfaces, and/or may have other mechanisms to influence the amount of friction and/or the transition between sticking and slipping. Several amplitude levels, excited mode shapes, and/or natural frequencies can be damped with such configurations. For example, turning to FIG. 10, a schematic illustration of a damping system 1000 in accordance with an embodiment of the present disclosure is shown. The damping system 1000 can operate similar to that shown and described above with respect to FIG. 7. The damping system 1000 includes first element 1010 and second elements 1012. However, in this embodiment, the second element 1012 that is mounted to the first element 1010 of a downhole system 1002 is formed from a first body 1018 and a second body 1020. The first body 1018 has a first contact surface 1022 between the first body 1018 and the first element 1010 and the second body 1020 has a second contact surface 1024 between the second body 1020 and the first element 1010. As shown, the first body 1018 is separated from the second body 1020 by a gap 1026. The gap 1026 is provided to prevent interaction between the first body 1018 and the second body 1020 such that they can operate (e.g., move) independent of each other or do not directly interact with each other. In this embodiment, the first body 1018 has a first static or dynamic friction coefficient pi and a first force $F_{N1}$ that is normal to the first contact surface 1022, whereas the second body 1020 has a second static or dynamic friction coefficient $\mu_2$ and a second force $F_{N2}$ that is normal to the second contact surface 1024. Further, the first body 1018 can have a first moment of inertia $J_1$ and the second body 1020 can have a second moment of inertia $J_2$. In some embodiments, at least one of the first static or dynamic friction coefficient $\mu_1$, the first normal force $F_{N1}$, and the first moment of inertia $J_1$ are selected to be different than the second static or dynamic friction coefficient $\mu_2$, the second normal force $F_{N2}$, and the second moment of inertia $J_1$, respectively. Thus, the damping system 1000 can be configured to account for multiple different mode shapes at a substantially single location along the downhole system 1002.

Figure 11:
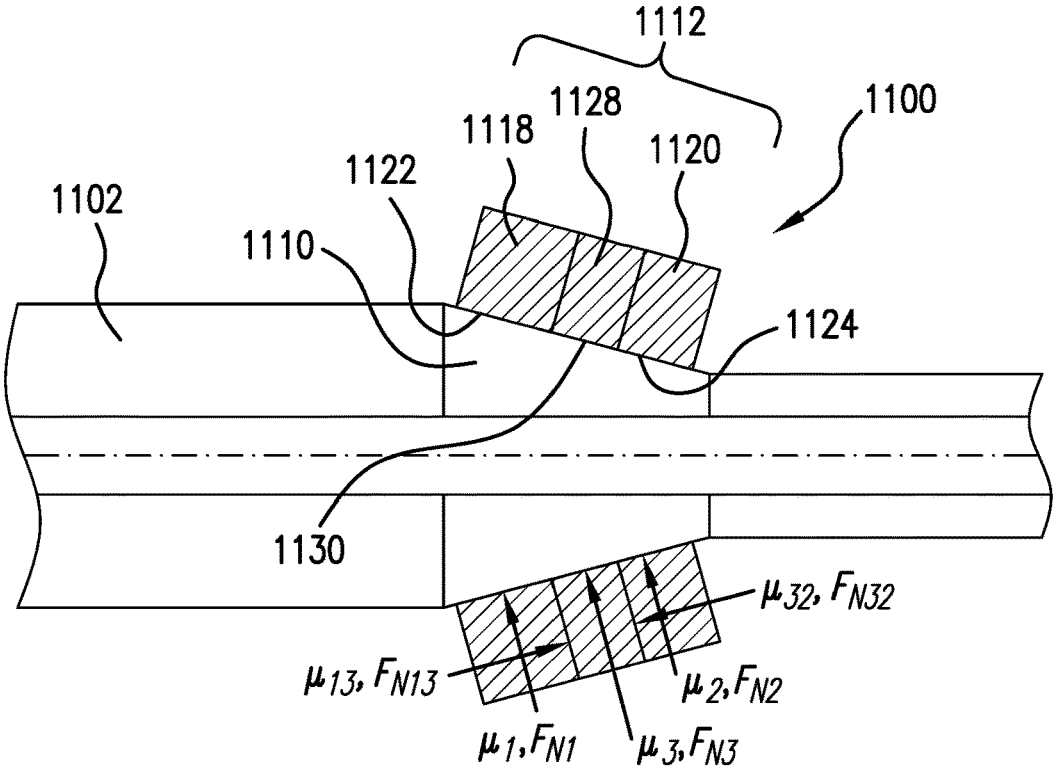
FIG. 11 is a schematic illustration of a damping system in accordance with an embodiment of the present disclosure.

Turning now to FIG. 11, a schematic illustration of a damping system 1100 in accordance with an embodiment of the present disclosure is shown. The damping system 1100 can operate similar to that shown and described above. However, in this embodiment, a second element 1112 that is mounted to a first element 1110 of a downhole system 1102 is formed from a first body 1118, a second body 1120, and a third body 1128. The first body 1118 has a first contact surface 1122 between the first body 1118 and the first element 1110, the second body 1120 has a second contact surface 1124 between the second body 1120 and the first element 1110, and the third body 1128 has a third contact surface 1130 between the third body 1128 and the first element 1110. As shown, the third body 1128 is located between the first body 1118 and the second body 1020. In this embodiment, the three bodies 1118, 1120, 1128 are in contact with each other and thus can have normal forces and static or dynamic friction coefficients therebetween.

The contact between the three bodies 1118, 1120, 1128 may be established, maintained, or supported by elastic connection elements such as spring elements between two or more of the bodies 1118, 1120, 1128. In addition, or alternatively, the first body 1118 may have a first static or dynamic friction coefficient pi and a first force $F_{N1}$ at the first contact surface 1122, the second body 1120 may have a second static or dynamic friction coefficient $\mu_2$ and a second force $F_{N2}$ at the second contact surface 1124, and the third body 1128 may have a third static or dynamic friction coefficient $\mu_3$ and a third force $F_{N3}$ at the third contact surface 1130.

In addition, or alternatively, the first body 1118 and the third body 1128 may have a fourth force $F_{N13}$ and a fourth static or dynamic friction coefficient $\mu_{13}$ between each other at a contact surface between the first body 1118 and the third body 1128. Similarly, the third body 1128 and the second body 1120 may have a fifth force $F_{N32}$ and a fifth static or dynamic friction coefficient $\mu_{32}$ between each other at a contact surface between the third body 1128 and the second body 1120.

Further, the first body 1118 can have a first moment of inertia $J_1$, the second body 1120 can have a second moment of inertia $J_2$, and the third body 1128 can have a third moment of inertia $J_3$. In some embodiments, the static or dynamic friction coefficients $\mu_1$, $\mu_2$, $\mu_3$, $\mu_{13}$, $\mu_{32}$, the forces $F_{N1}$, $F_{N2}$, $F_{N3}$, $F_{13}$, $F_{32}$, and the moment of inertia $J_1$, $J_2$, $J_3$ can be selected to be different than each other so that the product $\mu_i \cdot F_i$ (with i=1, 2, 3, 13, 32) are different for at least a subrange of the relative velocities of first element 1110, first body 1118, second body 1120, and third body 1128. Moreover, the static or dynamic friction coefficients and normal forces between adjacent bodies can be selected to achieve different damping effects.

Although shown and described with respect to a limited number of embodiments and specific shapes, relative sizes, and numbers of elements, those of skill in the art will appreciate that the damping systems of the present disclosure can take any configuration. For example, the shapes, sizes, geometries, radial placements, contact surfaces, number of bodies, etc. can be selected to achieve a desired damping effect. While in the arrangement that is shown in FIG. 11, the first body 1118 and the second body 1120 are coupled to each other by the frictional contact to the third body 1128, such arrangement and description is not to be limiting. The coupling between the first body 1118 and the second body 1120 may also be created by a hydraulic, electric, or mechanical coupling means or mechanism. For example, a mechanical coupling means between the first body 1118 and the second body 1120 may be created by a rigid or elastic connection of first body 1118 and the second body 1120.

Figure 12:
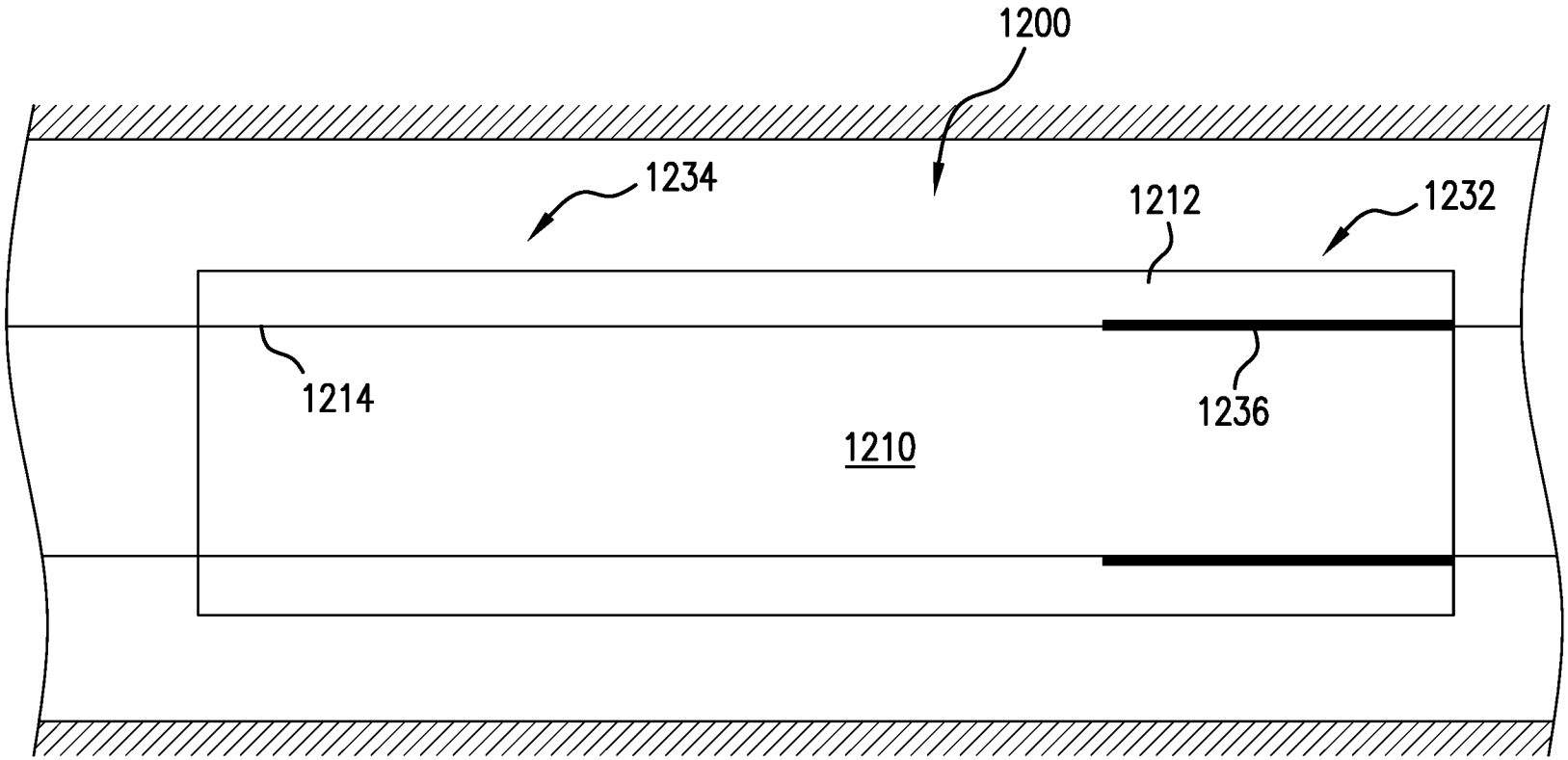
FIG. 12 is a schematic illustration of a damping system in accordance with an embodiment of the present disclosure.

Turning now to FIG. 12, a schematic illustration of a damping system 1200 in accordance with an embodiment of the present disclosure is shown. The damping system 1200 can operate similar to that shown and described above. However, in this embodiment, a second element 1212 of the damping system 1200 is partially fixedly attached to or connected to a first element 1210. For example, as shown in this embodiment, the second element 1212 has a fixed portion 1232 (or end) and a movable portion 1234 (or end). The fixed portion 1232 is fixed to the first element 1210 along a fixed connection 1236 and the movable portion 1234 is in frictional contact with the first element 1210 across the contact surface 1214 (similar to the first element 1010 in frictional contact with the second element 1012 described with respect to FIG. 10).

The movable portion 1234 can have any desired length that may be related to the mode shapes as shown in FIG. 9B. For example, in some embodiments, the movable portion may be longer than a tenth of the distance between the maximum and the minimum of any of the mode shapes that may have been calculated for a particular drilling assembly. In another example, in some embodiments, the movable portion may be longer than a quarter of the distance between the maximum and the minimum of any of the mode shapes that may have been calculated for a particular drilling assembly. In another example, in some embodiments, the movable portion may be longer than a half of the distance between the maximum and the minimum of any of the mode shapes that may have been calculated for a particular drilling assembly. In another example, in some embodiments, the movable portion may be longer than the distance between the maximum and the minimum of any of the mode shapes that may have been calculated for a particular drilling assembly.

As such, even though it may not be known where the exact location of mode maxima or minima is during a downhole deployment, it is assured that the second element 1212 is in frictional contact with the first element 1210 at a position of maximum amplitude to achieve optimized damping. Although shown with a specific arrangement, those of skill in the art will appreciate that other arrangements of partially fixed first elements are possible without departing from the scope of the present disclosure. For example, in one non-limiting embodiment, the fixed portion can be in a more central part of the first element such that the first element has two movable portions (e.g., at opposite ends of the first element). As can be seen in FIG. 12, the movable portion 1234 of the second element 1212 is rather elongated and may cover a portion of the mode shapes (such as mode shapes 902, 904, 906 in FIG. 9B) that correspond to the length of the movable portion 1234 of the second element 1212. An elongated second element 1212 in frictional contact with the first element 1210 may have advantages compared to shorter second elements because shorter second elements may be located in an undesired portion of the mode shapes such as in a damping location 910 where the second mode shape 904 is small or even zero as explained above with respect to FIG. 9B. Utilizing an elongated second element 1212 may ensure that at least a portion of the second element is at a distance from locations where one or more of the mode shapes are zero or at least close to zero. FIGS. 13-19 and 21-22 show more varieties of elongated second elements in frictional contact with first elements. In some embodiments, the elongated second elements may be elastic so that the movable portion 1234 is able move relative to the first element 1210 while the fixed portion 1232 is stationary relative to first element 1210. In some embodiments, the second element 1212 may have multiple contact points at multiple locations of the first element 1210.

In the above described embodiments, and in damping systems in accordance with the present disclosure, the first elements are temporarily fixed to the second elements due to a friction contact. However, as vibrations of the downhole systems increase, and exceed a threshold, e.g., when a force of inertia exceeds the static friction force, the first elements (or portions thereof) move relative to the second elements, thus providing the damping. That is, when HFTO increase above predetermined thresholds (e.g., thresholds of amplitude, distance, velocity, and/or acceleration) within the downhole systems, the damping systems will automatically operate, and thus embodiments provided herein include passive damping systems. For example, embodiments include passive damping systems automatically operating without utilizing additional energy and therefore do not utilize an additional energy source.

Figure 13:
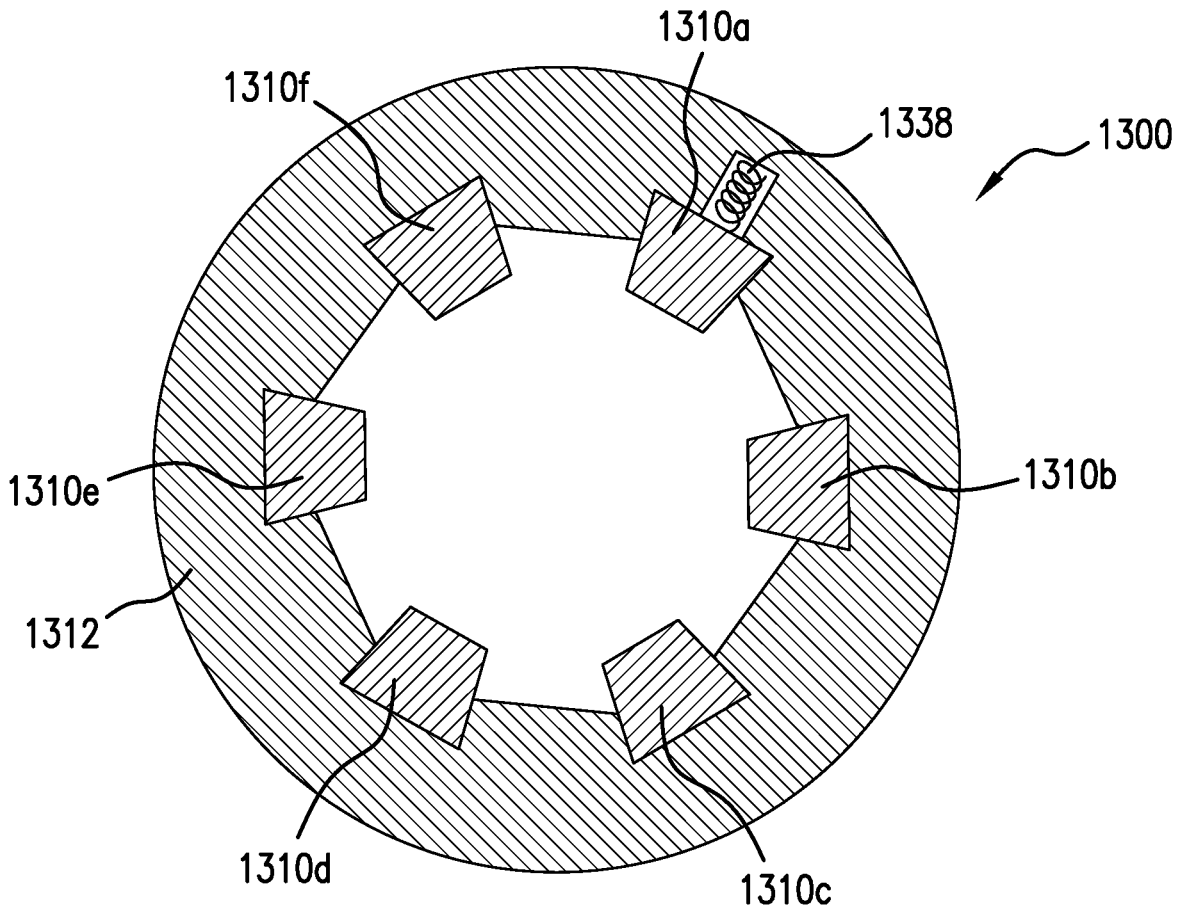
FIG. 13 is a schematic illustration of a damping system in accordance with an embodiment of the present disclosure.
Figure 14:
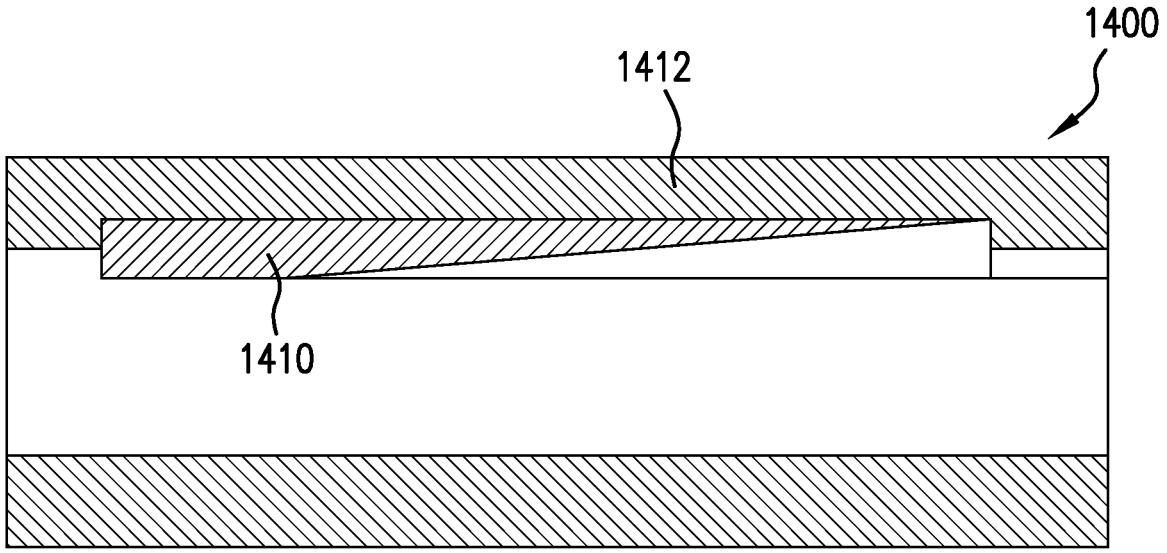
FIG. 14 is a schematic illustration of a damping system in accordance with an embodiment of the present disclosure.

Turning now to FIG. 13, a schematic illustration of a damping system 1300 in accordance with an embodiment of the present disclosure is shown. In this embodiment, the damping system 1300 includes one or more elongated first elements 1310*a*, 1310*b*, 1310*c*, 1310*d*, 1310*e*, 1310*f*, each of which is arranged within and in contact with a second element 1312. Each of the first elements 1310*a*, 1310*b*, 1310*c*, 1310*d*, 1310*e*, 1310*f* may have a length in an axial tool direction (e.g., in a direction perpendicular to the cross-section that is shown in FIG. 13) and optionally a fixed point where the respective first elements 1310*a*, 1310*b*, 1310*c*, 1310*d*, 1310*e*, 1310*f* are fixed to the second element 1312. For example, the first elements 1310*a*, 1310*b*, 1310*c*,

1310*d*, 1310*e*, 1310*f* can be fixed at respective upper ends, middle portions, lower ends, or multiple points of fixation for the different first elements 1310*a*, 1310*b*, 1310*c*, 1310*d*, 1310*e*, 1310*f*, or multiple points for a given single first element 1310*a*, 1310*b*, 1310*c*, 1310*d*, 1310*e*, 1310*f* Further, as shown in FIG. 13, the first elements 1310*a*, 1310*b*, 1310*c*, 1310*d*, 1310*e*, 1310*f* can be optionally biased or engaged to the second element 1312 by a biasing element 1338 (e.g., by a biasing spring element or a biasing actuator applying a force with a component toward the second element 1312). Each of the first elements 1310*a*, 1310*b*, 1310*c*, 1310*d*, 1310*e*, 1310*f* can be arranged and selected to have the same or different normal forces, static or dynamic friction coefficients, and mass moments of inertia, thus enabling various damping configurations.

In some embodiments, the first elements may be substantially uniform in material, shape, and/or geometry along a length thereof. In other embodiments, the first elements may vary in shape and geometry along a length thereof. For example, with reference to FIG. 14, a schematic illustration of a damping system 1400 in accordance with an embodiment of the present disclosure is shown. In this embodiment, a first element 1410 is arranged relative to a second element 1412, and the first element 1410 has a tapering and/or spiral arrangement relative to the second element 1412. Accordingly, in some embodiments, a portion of the first or second element can change geometry or shape along a length thereof, relative to the second element, and such changes can also occur in a circumferential span about or relative to the second element and/or with respect to a tool body or downhole system.

Figure 15:
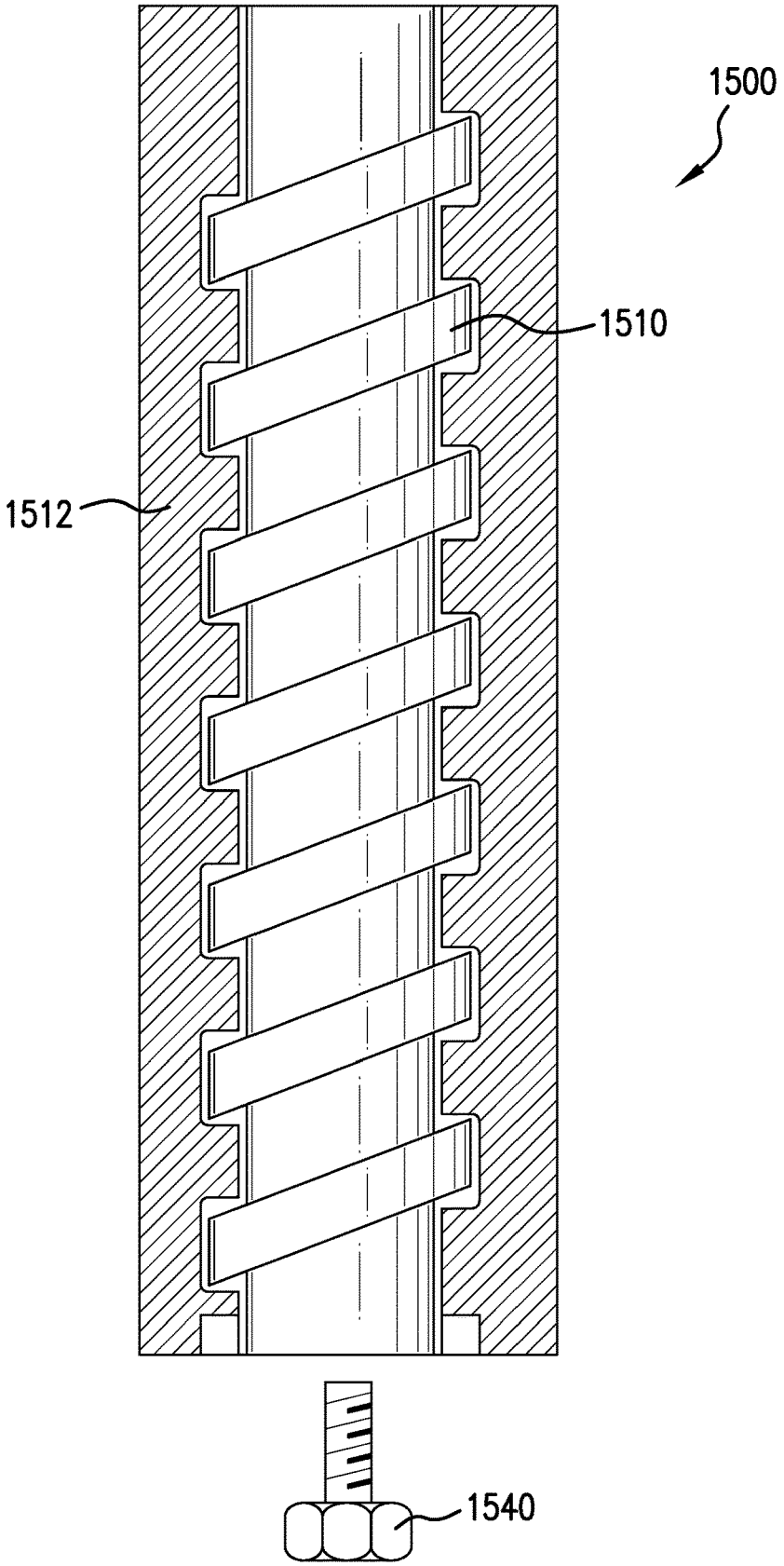
FIG. 15 is a schematic illustration of a damping system in accordance with an embodiment of the present disclosure.

Turning now to FIG. 15, a schematic illustration of another damping system 1500 in accordance with an embodiment of the present disclosure is shown. In the damping system 1500, a first element 1510 is a toothed (threaded) body that is fit within a threaded second element 1512. The contact between the teeth (threads) of the first element 1510 and the threads of the second element 1512 can provide the frictional contact between the two elements 1510, 1512 to enable damping as described herein. Due to the slanted surfaces of the first element 1510, the first element 1510 will start to move under both axial and/or torsional vibrations. Further, movement of first element 1510 in an axial or circumferential direction will also create movement in the circumferential or axial direction, respectively, in this configuration. Therefore, with the arrangement shown in FIG. 15, axial vibrations can be utilized to mitigate or damp torsional vibrations as well as torsional vibrations can be utilized to mitigate or damp axial vibrations. The locations where the axial and torsional vibrations occur may be different. For example, while the axial vibrations may be homogeneously distributed along the drilling assembly, the torsional vibrations may follow a mode shape pattern as discussed above with respect FIGS. 9A-9B. Thus, irrespective of where the vibrations occur, the configuration shown in FIG. 15 may be utilized to damp torsional vibrations with the movement of the first element 1510 relative to the second element 1512 caused by the axial vibrations and vice versa. As shown, an optional tightening element 1540 (e.g., a bolt) can be used to adjust the contact pressure or normal force between the two elements 1510, 1512, and thus adjust the frictional force and/or other damping characteristics of the damping system 1500.

Figure 16:
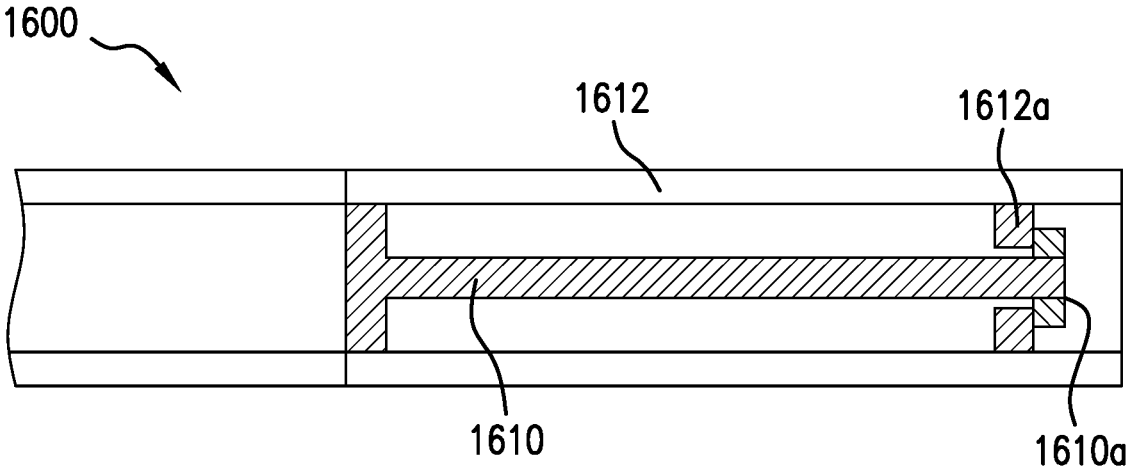
FIG. 16 is a schematic illustration of a damping system in accordance with an embodiment of the present disclosure.

Turning now to FIG. 16, a schematic illustration of a damping system 1600 in accordance with another embodiment of the present disclosure is shown. The damping system 1600 that includes a first element 1610 that is a stiff rod that is at one end fixed within a second element 1612. In this embodiment, a rod end 1610*a* is arranged to frictionally contact a second element stop 1612*a* to thus provide damping as described in accordance with embodiments of the present disclosure. The normal force between the rod end 1610*a* and the second element stop 1612*a* may be adjustable, for example, by a threaded connection between the rod end 1610*a* and the first element 1610. Further, the stiffness of the rod could be selected to optimize the damping or influence the mode shape in a beneficial way to provide a larger relative displacement. For example, selecting a rod with a lower stiffness would lead to higher amplitudes of the torsional oscillations of the first element 1610 and a higher energy dissipation.

Figure 17:
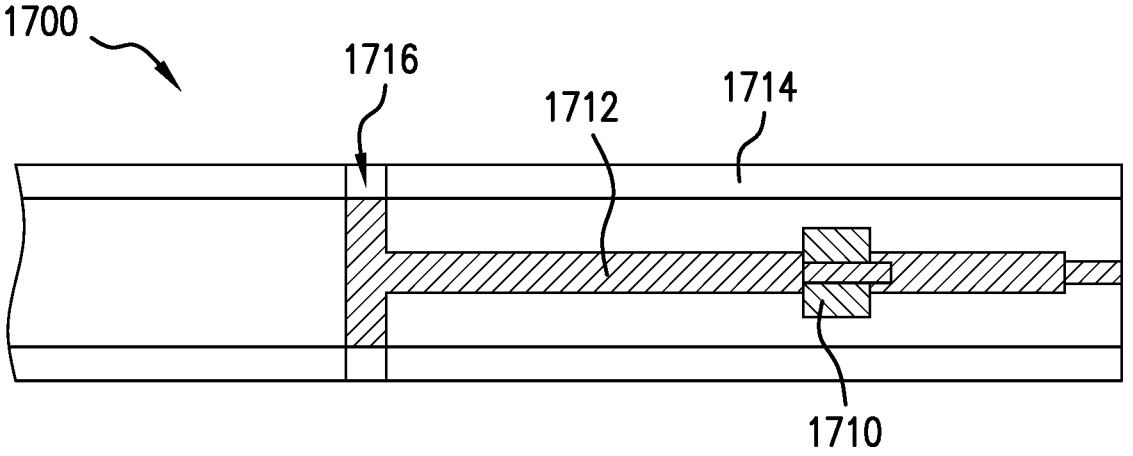
FIG. 17 is a schematic illustration of a damping system in accordance with an embodiment of the present disclosure.

Turning now to FIG. 17, a schematic illustration of a damping system 1700 in accordance with another embodiment of the present disclosure is shown. The damping system 1700 that includes a first element 1710 that is frictionally attached or connected to a second element 1712 that is arranged as a stiff rod and that is fixedly connected (e.g., by welding, screwing, brazing, adhesion, etc.) to an outer tubular 1714, such as a drill collar, at a fixed connection 1716. In one aspect, the rod may be a tubular that includes electronic components, power supplies, storage media, batteries, microcontrollers, actuators, sensors, etc. that are prone to wear due to HFTO. That is, in one aspect, the second element 1712 may be a probe, such as a probe to measure directional information, including one or more of a gravimeter, a gyroscope, and a magnetometer. In this embodiment, the first element 1710 is arranged to frictionally contact, move, or oscillate relative to and along the fixed rod structure of the second element 1712 to thus provide damping as described in accordance with embodiments of the present disclosure. While the first element 1710 is shown in FIG. 17 to be relatively small compared to the damping system 1700, it is not meant to be limited in that respect. Thus, the first element can 1710 can be of any size and can have the same outer diameter as the damping system 1700. Further, the location of the first element 1710 may be adjustable in order to move the first element 1710 closer to a mode shape maximum to optimize damping mitigation.

Figure 18:
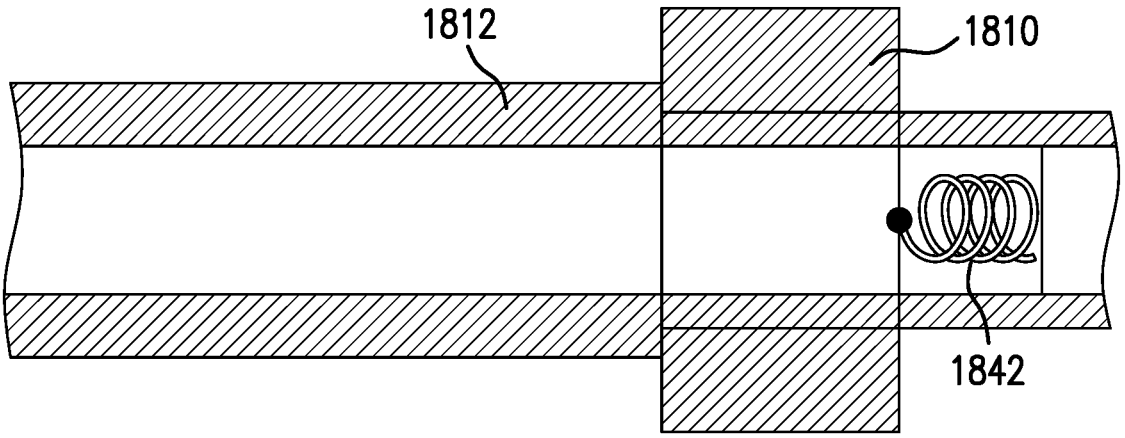
FIG. 18 is a schematic illustration of a damping system in accordance with an embodiment of the present disclosure.

Turning now to FIG. 18, a schematic illustration of a damping system 1800 in accordance with another embodiment of the present disclosure is shown. The damping system 1800 that includes a first element 1810 that is frictionally movable along a second element 1812. In this embodiment, the first element 1810 is arranged with an elastic spring element 1842, such as a helical spring or other element or means, to engage the first element 1810 with the second element 1812, and to thus provide a restoring force when the first element 1810 has moved and is deflected relative to the second element. The restoring force is directed to reduce the deflection of the first element 1810 relative to the second element 1812. In such embodiments, the elastic spring element 1842 can be arranged or tuned to resonance and/or to a critical frequency (e.g., lowest critical frequency) of the elastic spring element 1842 or the oscillation system comprising the first element 1810 and the elastic spring element 1842.

Figure 19:
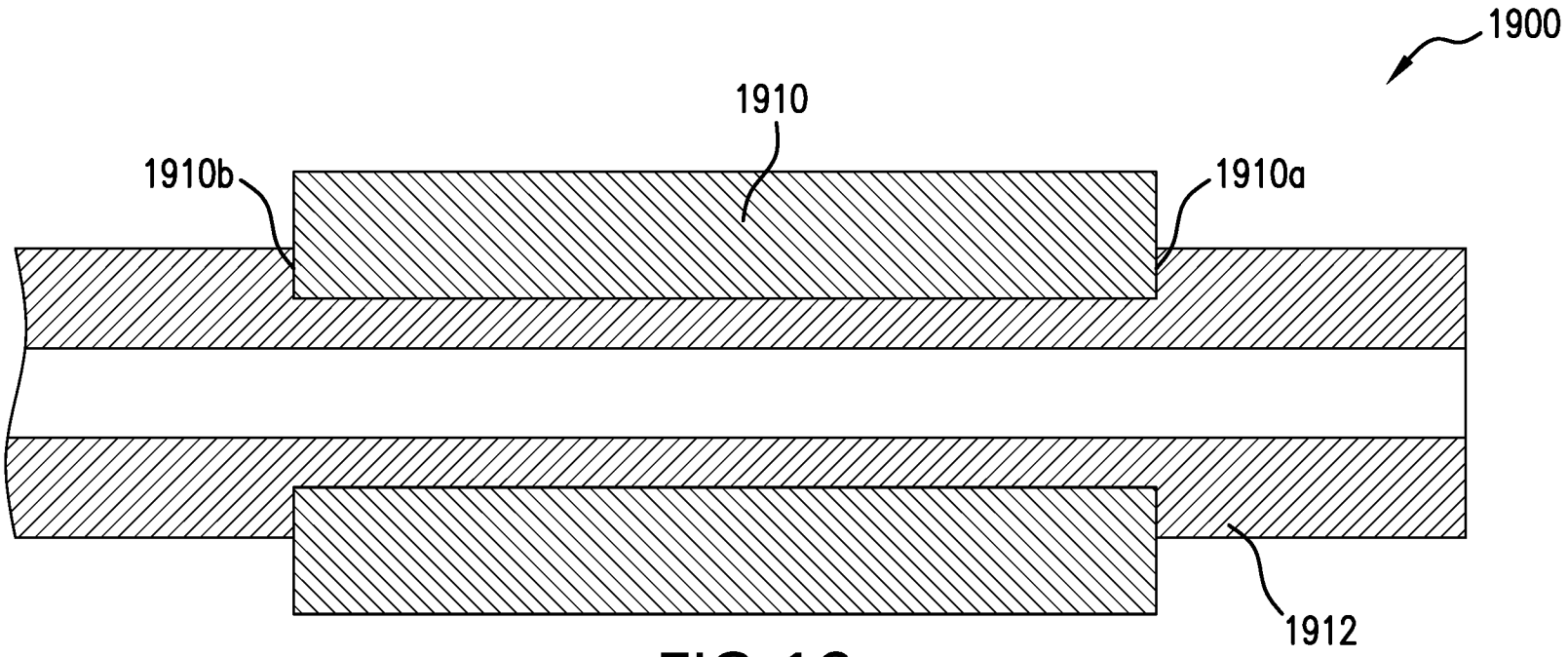
FIG. 19 is a schematic illustration of a damping system in accordance with an embodiment of the present disclosure.

Turning now to FIG. 19, a schematic illustration of a damping system 1900 in accordance with another embodiment of the present disclosure is shown. The damping system 1900 that includes a first element 1910 that is frictionally movable about a second element 1912. In this embodiment, the first element 1910 is arranged with a first end 1910*a* having a first contact (e.g., first end normal force $F_{Ni}$, first end static or dynamic friction coefficient $\mu_i$, and first end moment of inertia $J_i$) and a second contact at a second end 1910*b* (e.g., second end normal force $F_{Ni}$, second end static or dynamic friction coefficient $\mu_i$, and second end moment of inertia $J_i$). In some such embodiments, the type of interaction between the respective first end 1910*a* or second end 1910*b* and the second element 1912 may have a different physical characteristics. For example, one or both of the first end 1910*a* and the second end 1910*b* may have a sticking contact/engagement and one or both may have a sliding contact/engagement. The arrangements/configurations of the first and second ends 1910*a*, 1910*b* can be set to provide damping as described in accordance with embodiments of the present disclosure.

Advantageously, embodiments provided herein are directed to systems for mitigating high-frequency torsional oscillations (HFTO) of downhole systems by application of damping systems that are installed on a rotating string (e.g., drill string). The first elements of the damping systems are, at least partially, frictionally connected to move circumferentially relative to an axis of the string (e.g., frictionally connected to rotate about the axis of the string). In some embodiments, the second elements can be part of a drilling system or bottomhole assembly and does not need to be a separately installed component or weight. The second element, or a part thereof, is connected to the downhole system in a manner that relative movement between the first element and the second element has a relative velocity of zero or close to zero (i.e., no or slow relative movement) if no HFTO exists. However, when HFTO occurs above a distinct acceleration value, the relative movement between the first element and the second element is possible and alternating plus and minus relative velocities are achieved. In some embodiments, the second element can be a mass or weight that is connected to the downhole system. In other embodiments, the second element can be part of the downhole system (e.g., part of a drilling system or BHA) with friction between the first element and the second element, such as the rest of the downhole system providing the functionality described herein.

As described above, the second elements of the damping systems are selected or configured such that when there is no vibration (i.e., HFTO) in the string, the second element will be frictionally connected to the first element by the static friction force. However, when there is vibration (HFTO), the second elements become moving with respect to the first element and the frictional contact between the first and the second element is reduced as described above with respect to FIG. 2, such that the second element can rotate (move) relative to the first element (or vice versa). When moving, the first and second elements enable energy dissipation, thus mitigating HFTO. The damping systems, and particularly the first elements thereof, are positioned, weighted, forced, and sized to enable damping at one or more specific or predefined vibration modes/frequencies. As described herein, the first elements are fixedly connected when no HFTO vibration is present but are then able to move when certain accelerations (e.g., according to HFTO modes) are present, thus enabling dampening of HFTO through a zero crossing of a relative velocity (e.g., switching between positive and negative relative rotational velocities).

In the various configurations discussed above, sensors can be used to estimate and/or monitor the efficiency and the dissipated energy of a damper. The measurement of displacement, velocity, and/or acceleration near the contact point or surface of the two interacting bodies, for example in combination with force or torque sensors, can be used to estimate the relative movement and calculate the dissipated energy. The force may also be known without a measurement, for example, when the two interacting bodies are engaged by a biasing element, such as a spring element or an actuator. The dissipated energy could also be derived from temperature measurements. Such measurement values may be transmitted to a controller or human operator which may enable adjustment of parameters such as the normal force and/or the static or dynamic friction coefficient(s) to achieve a higher dissipated energy. For example, measured and/or calculated values of displacement, velocity, acceleration, force, and/or temperature may be sent to a controller, such as a micro controller, that has a set of instructions stored to a storage medium, based on which it adjusts and/or controls at least one of the force that engages the two interacting bodies, and/or the static or dynamic friction coefficients. Preferably, the adjusting and/or the controlling is done while the drilling process is ongoing to achieve optimum HFTO damping results.

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Severe vibrations in drillstrings and bottomhole assemblies can be caused by cutting forces at the bit or mass imbalances in downhole tools such as drilling motors. Negative effects are among others reduced rate of penetration, reduced quality of measurements and downhole failures.

Different sorts of torsional vibrations exist. In the literature the torsional vibrations are mainly differentiated into stick/slip of the whole drilling system and high-frequency torsional oscillations (HFTO). Both are mainly excited by self-excitation mechanisms that occur due to the interaction of the drill bit and the formation. The main differentiator between stick/slip and HFTO is the frequency and the typical mode shape: In case of HFTO the frequency is above 50 Hz compared to below 1 Hz in case of stick/slip. Further the excited mode shape of stick/slip is the first mode shape of the whole drilling system whereas the mode shape of HFTOs are commonly localized to a small portion of the drilling system and have comparably high amplitudes at the bit.

Due to the high frequency HFTO corresponds to high acceleration and torque values along the BHA and can have damaging effects on electronics and mechanical parts. Based on the theory of self-excitation increased damping can mitigate HFTOs if a certain limit of the damping value is reached (since self-excitation is an instability and can be interpreted as a negative damping of the associated mode).

One damping concept is based on friction. Friction between two parts in the BHA or drill string can dissipate energy and reduce the level of torsional oscillations.

In this idea a design principle is discussed that to the opinion of the inventors works best for damping with friction. The damping shall be achieved by a friction force where the operating point of the friction force with respect to the relative velocity has to be around point 204 shown in FIG. 2. This operating point leads to a high energy dissipation because a friction hysteresis is achieved whereas point 202 of FIG. 2 will lead to energy input into the system.

As discussed above, friction forces between the drilling system and the borehole will not generate significant additional damping in the system. This is because the relative velocity between the contact surfaces (e.g. a stabilizer and the borehole) does not have a zero mean value. The two interacting bodies of the friction damper must have a mean velocity or rotary speed relative to each other that is small enough so that the HFTO leads to a sign change of the relative velocity of the two interacting bodies of the friction damper. In other words, the maximum of the relative velocities between the two interacting bodies generated by the HFTO needs to be higher than the mean relative velocity between the two interacting bodies.

Energy dissipation only occurs in a slipping phase via the interface between the damping device and the drilling system. Slipping occurs if the inertial force exceeds the limit between sticking and slipping that is the static friction force: $F_R > \mu_0 \cdot F_N$ (wherein the static friction force equals the static friction coefficient multiplied by the normal force between both contacting surfaces). The normal force and/or the static or dynamic friction coefficient may be adjustable to achieve an optimal or desired energy dissipation. Adjusting at least one of the normal force and the static or dynamic friction coefficient may lead to an improved energy dissipation by the damping system.

As discussed herein, the placement of the friction damper should be in the area of high HFTO accelerations, loads, and/or relative movement. Because different modes can be affected a design is preferred that is able to mitigate all HFTO modes (e.g., FIGS. 9A and 9B).

Figure 21:
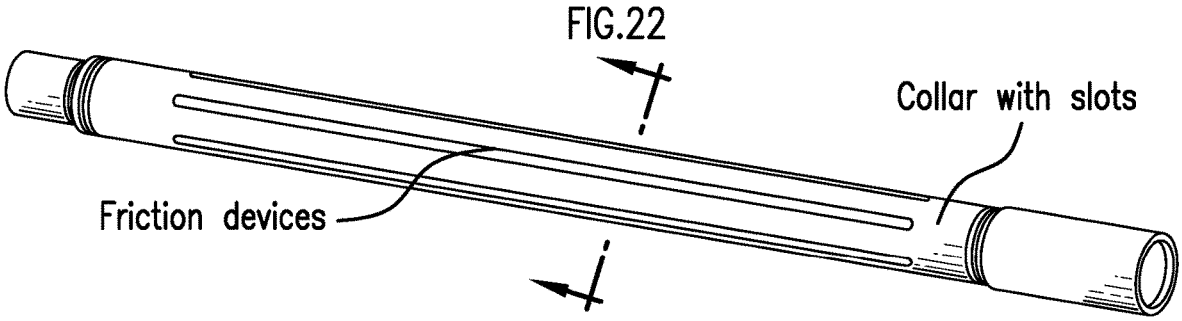
FIG. 21 is a schematic illustration of a downhole tool having a damping system.
Figure 22:
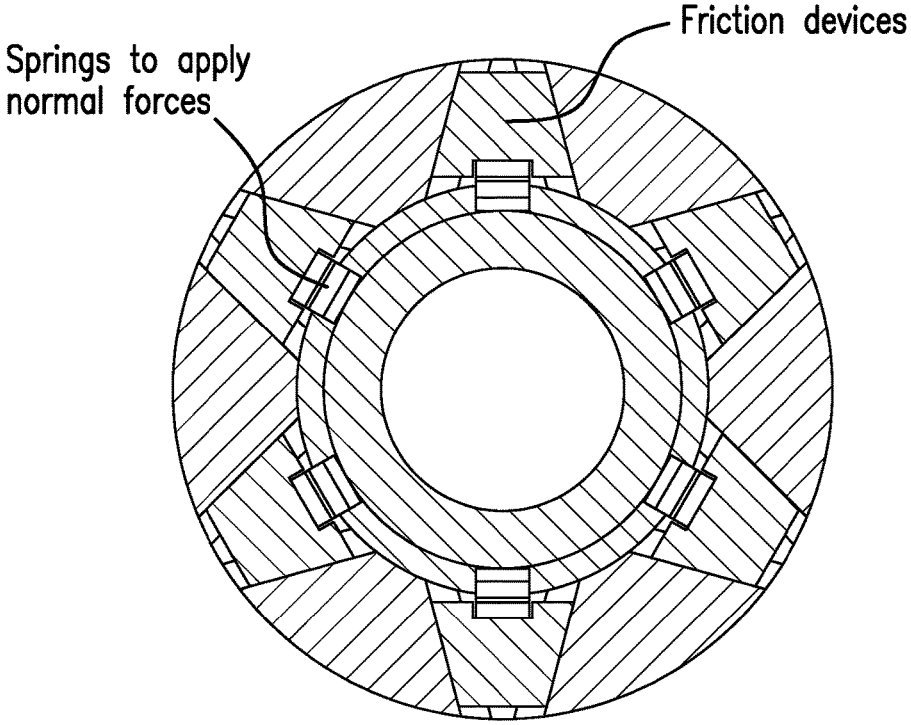
FIG. 22 is a cross-sectional illustration of the downhole tool of FIG. 21.

An equivalent can be used as a friction damper tool of the present disclosure. A collar with slots as shown in FIGS. 21 and 22 can be employed. A cross-sectional view of the collar with slots is shown in FIG. 22. In one non-limiting embodiment, the collar with slots has a high flexibility and will lead to higher deformations if no friction devices are entered. The higher velocity will cause higher centrifugal forces that will force the friction devices that will be pressed into the slots with optimized normal forces to allow high friction damping. In this configuration, other factors that can be optimized are the number and geometry of slots as well as the geometry of the damping devices. An additional normal force can be applied by spring elements, as shown in FIG. 22, actuators, and/or by centrifugal forces, as discussed above.

The advantage of this principle is that the friction devices will be directly mounted into the force flow. A twisting of the collar due to an excited HFTO mode and corresponding mode shape will partly be supported by the friction devices that will move up and down during one period of vibration. The high relative movement along with an optimized friction coefficient and normal force will lead to a high dissipation of energy.

This goal is to prevent an amplitude increase of the HFTO amplitudes (represented by tangential acceleration amplitudes in this case). The (modal) damping that has to be added to every instable torsional mode by the friction damper system needs to be higher than the energy input into the system. The energy input is not happening instantaneously but over many periods until the worst case amplitude is reached (zero RPM at the bit).

With this concept a comparably short collar can be used because the friction damper uses the relative movement along the distance from bit. It is not necessary to have a high tangential acceleration amplitude but only some deflection ("twisting") of the collar that will be achieved in nearly every place along the BHA. The collar and the dampers should have a similar mass to stiffness ratio ("impedance") compared to the BHA. This would allow the mode shape to propagate in the friction collar. A high damping will be achieved that will mitigate HFTO if the parameters discussed above are adjusted (normal force due to springs etc.). The advantage in comparison to other friction damper principles is the application of the friction devices directly into the force flow of the deflection to a HFTO mode. The comparably high relative velocity between the friction devices and the collar will lead to a high dissipation of energy.

The damper will have a high benefit and will work for different applications. HFTO causes high costs due to high repair and maintenance efforts, reliability issues with non-productive time and small market share. The proposed friction damper would work below a motor (that decouples HFTO) and also above a motor. It could be mounted in every place of the BHA that would also include a placement above the BHA if the mode shape propagates to this point. The mode shape will propagate through the whole BHA if the mass and stiffness distribution is relatively similar. An optimal placement could for example be determined by a torsional oscillation advisor that allows a calculation of critical HFTO-modes and corresponding mode shapes.

Figure 23:
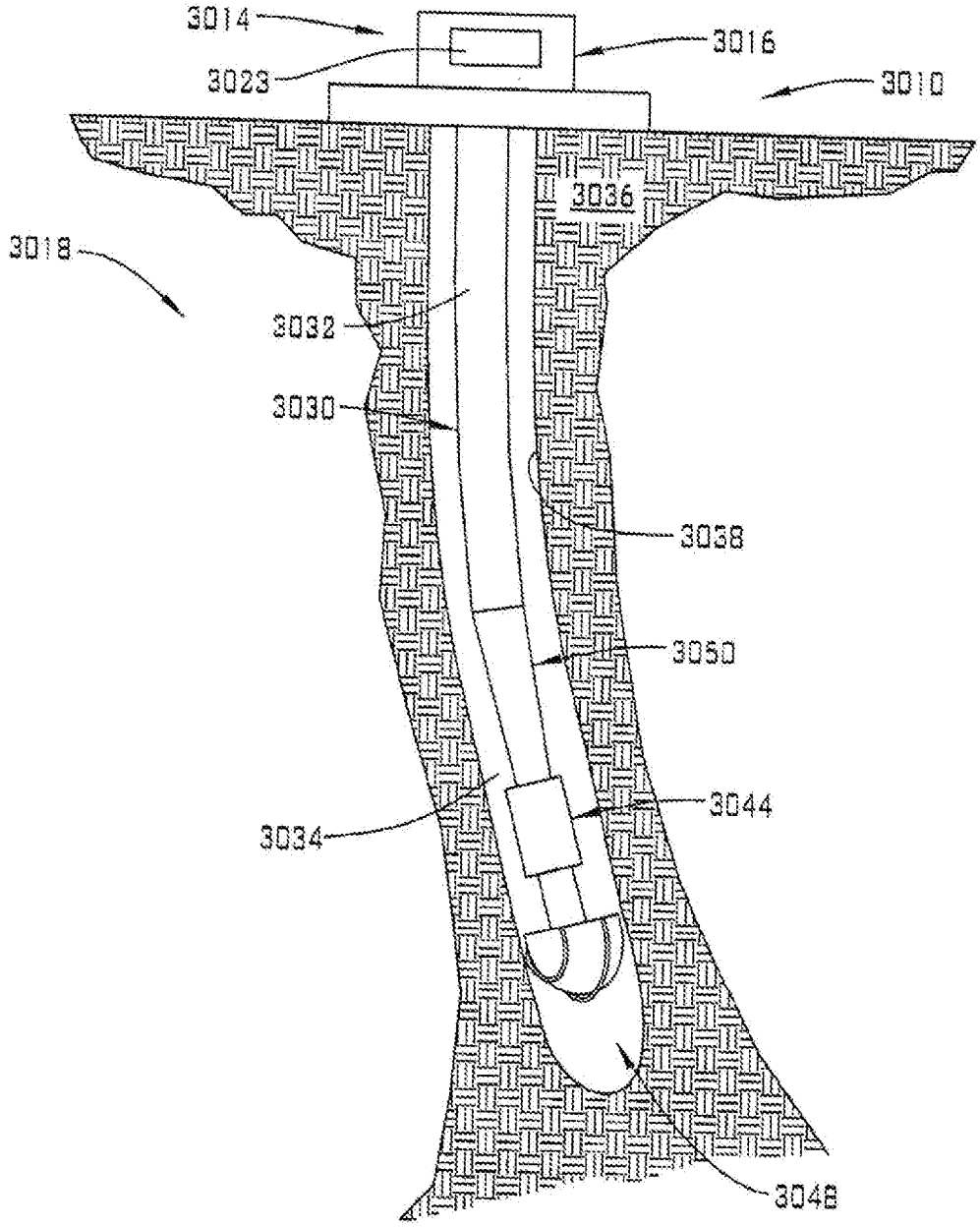
FIG. 23 depicts a resource exploration and recovery system including a vibration isolation device, in accordance with an exemplary embodiment.

A resource exploration and recovery system, in accordance with an exemplary embodiment, is indicated generally at 3010, in FIG. 23. Resource exploration and recovery system 3010 should be understood to include well drilling operations, resource extraction and recovery, $CO_2$ sequestration, and the like. Resource exploration and recovery system 3010 may include a first system 3014 which, in some environments, may take the form of a surface system 3016 operatively and fluidically connected to a second system 3018 which, in some environments, may take the form of a downhole system. First system 3014 may include a control system 3023 that may provide power to, monitor, communicate with, and/or activate one or more downhole operations as will be discussed herein. Surface system 3016 may include additional systems such as pumps, fluid storage systems, cranes and the like (not shown).

Second system 3018 may include a tubular string 3030, formed from one or more tubulars 3032, which extends into a borehole or wellbore 3034 formed in formation 3036. Wellbore 3034 includes an annular wall 3038 which may be defined by a surface of formation 3036. In an embodiment, tubular string 3030 takes the form of a drill string (not separately labeled that supports a bottom hole assembly (BHA) 3044 which, in turn, is connected to a drill bit 3048 that is operated to form wellbore 3034. That is, BHA 3044 includes drill bit 3048 as well as drill collars and other components (not separately labeled). BHA 3044 may include a rotary steerable tool, a drilling motor, sensing tools, such as a resistivity measurement tool, a gamma measurement tool, a density measurement tool, a directional measurement tool, stabilizer, and a power and/or communication tool. In accordance with an exemplary embodiment, a vibration isolation device 3050 is mechanically connected above, below, or between components of BHA 3044. Vibration isolation device 3050 is a modular tool that can be installed at various positions above, below, or within BHA 3044. For example, vibration solation device 3050 can be installed above a steering unit (not shown) and below one or more formation evaluation tools. Vibration isolation device 3050 defines a flexible connection that limits vibrations, for example, high frequency torsional oscillations (HFTO) that may result from drill bit 3048 passing through components of second system 3018 toward surface system 3016.

Figure 24:
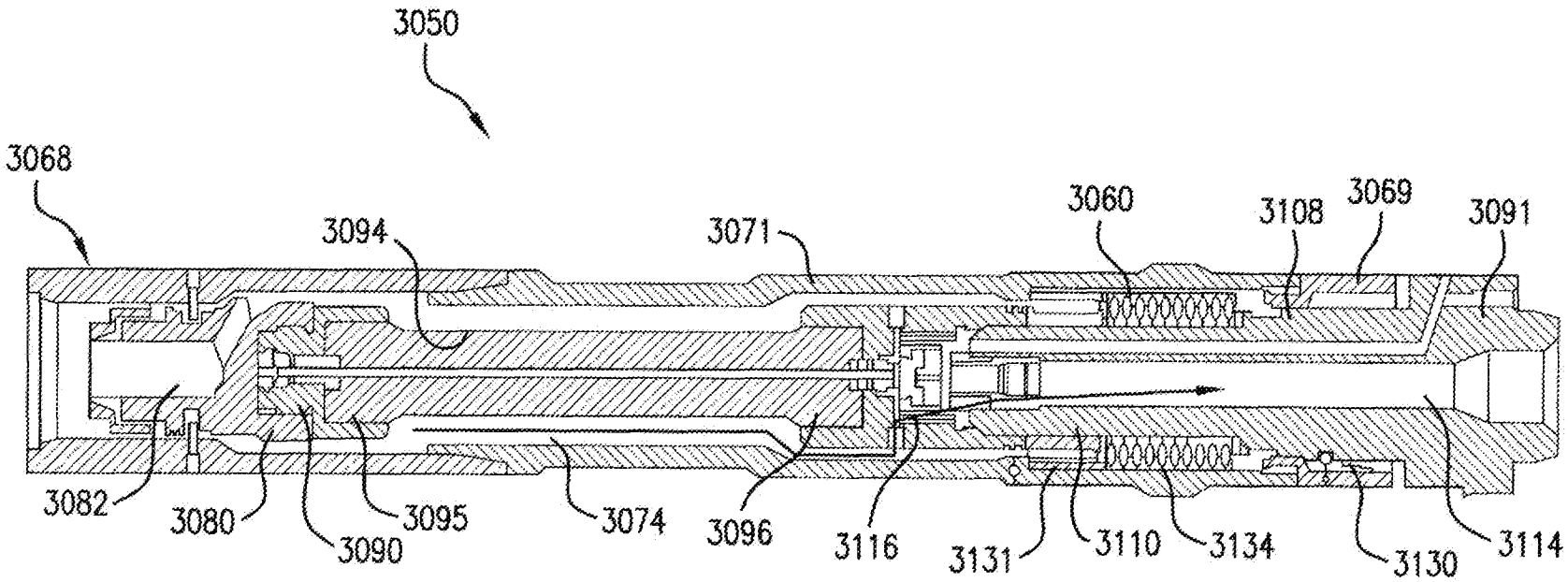
FIG. 24 depicts the vibration isolation device, in accordance with an aspect of an exemplary embodiment.
Figure 25:
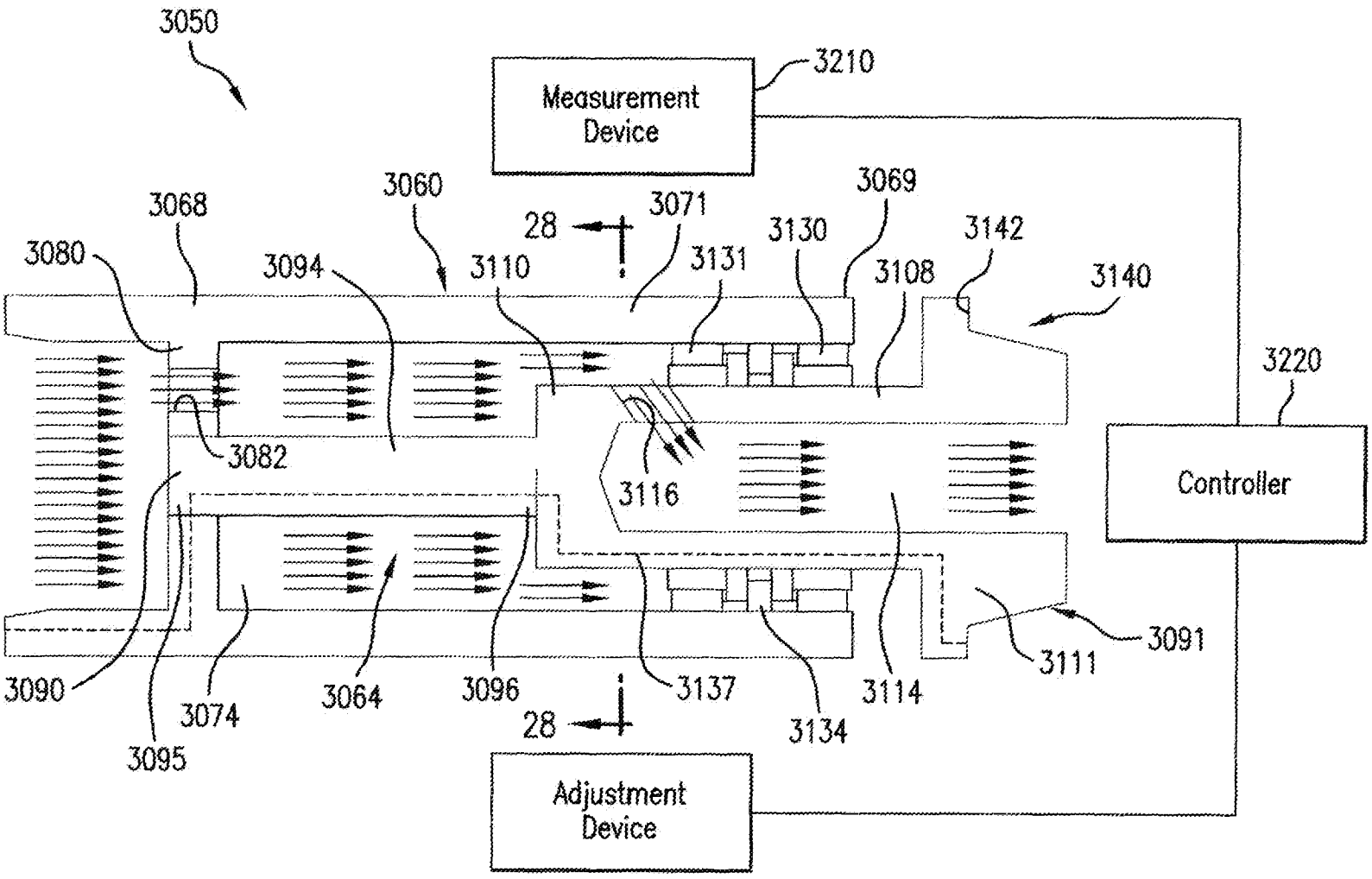
FIG. 25 depicts a schematic view of the vibration isolation device, in accordance with an aspect of an exemplary embodiment.

Reference will now follow to FIGS. 24 and 25 in describing vibration isolation device 3050 in accordance with an exemplary aspect. Vibration isolation device 3050 includes a support element 3060 that may be rotated, for example rotated about a borehole or wellbore axis, by a drive at the earth's surface (for example a so-called top drive) or by a drive that is included within the BHA (for example a drilling motor). While the present disclosure can be advantageously utilized in BHAs with a drilling motor, it is of even more use in BHAs without a drilling motor. Vibration isolation device 3050 further includes a torsional flexible element 3064. In the embodiment shown, torsional flexible element 3064 is arranged within support element 3060 as will be discussed herein. However, it should be understood that the relative position of support element 3060 and torsional flexible element 3064 may vary.

In accordance with an exemplary embodiment, support element 3060 includes a first end portion 3068, a second end portion 3069 and an intermediate portion 3071 extending therebetween. First end portion 3068 may be connected to other components of the BHA 3044 and second system 3018, for example by a thread. Intermediate portion 3071 includes an inner wall (not separately labeled) that defines an internal portion 3074. A blocking element 3080 is arranged proximate to first end portion 3068 within internal portion 3074. Blocking element 3080 prevents relative rotation between support member 3060 and drill bit 3048 in at least one direction. In one exemplary embodiment, blocking element 3080 is fixedly attached to support member 3060. Fixed attachment of blocking element 3080 to support member 3060 may be achieved by screws, clamps, welding, adhesive attachment, or similar means. Blocking element 3080 may include a mud flow passage 3082 that permits a flow of, for example, drilling mud to enter internal portion 3074. Support element 3060 may be formed from, for example, steel or alloys thereof.

In further accordance with an exemplary embodiment, torsional flexible element 3064 includes a first end 3090, and a second end 3091. First end 3090 defines a shaft 3094 having a first end section 3095 and a second end section 3096. Shaft 3094 is formed from a material and/or shape that is more flexible than support element 3060. A parameter of the torsional flexibility of the torsional flexible element 3064 is the torsional spring constant (also known as spring's torsion coefficient, torsion elastic modulus, or spring constant) of the torsional flexible element 3064. For example, shaft 3094 may be formed from titanium, titanium alloys brass, aluminum, aluminum alloys, nickel alloys, steel, such as high strength steel, alloys of steel, a composite, or carbon fiber. Material of shaft 3094 may be selected by its shear modulus which affects the spring constant of shaft 3094. Material of shaft 3094 may also be selected by its density which is related to the mass or moment of inertia of shaft 3094 which also affects the isolation efficiency of shaft 3094. A lower mass or moment of inertia, and thus, a lower density of shaft 3094 increases the isolation efficiency of shaft 3094. More specifically, torsional flexible element 3064 and/or shaft 3094 is formed from a material, and is sized and shaped to provide a selected flexibility that promotes relative angular rotation relative to support element 3060 in order to isolate predetermined vibrations resulting from HFTO.

Thus, in an embodiment, vibration isolation device 3050 is designed to possess a torsional flexibility per unit length that is greater than a torsional flexibility, per unit length of at least a portion of the BHA. For example, in an embodiment, vibration isolation device 3050 is designed to possess a torsional flexibility per unit length or that is greater than a torsional flexibility per unit length of support element 3060 or a component above support element 3060. An effective isolation may be achieved if the torsional spring constant of the torsional flexible element 3064 is lower than other components in the BRA 3044 or vibration isolation device 3050. For example, an effective isolation may be achieved if the torsional spring constant of the torsional flexible element 3064 is at least 10 times lower than other components in the BHA 3044 or vibration isolation device 3050 (e.g. support element 3060). For example, an effective isolation may be achieved if the torsional spring constant of the torsional flexible element 3064 is at least 50 times lower than other components in the BHA 3044 or vibration isolation device 3050 (e.g. support element 3060). In order to create such a torsional flexible portion the moment of inertia can be reduced, the length of the torsional flexible portion can be increased, and/or a material with a lower shear modulus can be selected. For a cylindrical torsional flexible element 3064 with a material that has a given shear modulus, the second moment of area can be decreased or the length can be increased to decrease torsional spring constant.

In the embodiment of FIGS. 24 and 25, first end section 3095 is fixedly connected to blocking element 3080. Second end 3091 defines a coupler 3108 that connects with, for example, drill bit 3048. It should be understood that coupler 3108 could connect with other downhole components, such as, for example, a steering unit that in turn is connected to drill bit 3048. Coupler 3108 includes a base portion 3110 that is connected to or an integral part with second end section 3096 of shaft 3094 and a connector portion 3111. Coupler 3108 includes a central passage 3114 that is fluidically connected with internal portion 3074 via a mud flow diverter or mud flow opening 3116. In this manner, a flow of mud may pass through vibration isolation device 3050 from the earth's surface to the drill bit 3048. While FIG. 25 shows the mud flow around torsional flexible element 3064 and shaft 3094, this is not to be understood as a limitation. In alternative embodiments, the mud may flow through a channel (not shown) within torsional flexible element 3064 or shaft 3094 to central passage 3114 and the drill bit 3048. However, guiding the drilling fluid around torsional flexible element 3064 and shaft 3094 allows to build shaft 3094 as a solid rod without a fluid passage through the rod that would negatively affect the isolation efficiency of torsional flexible element 3064.

In still further accordance with an exemplary embodiment, a first radial bearing 3130 is arranged between drill bit 3048 and support element 3060. For example, in an exemplary embodiment, a first radial bearing 3130 is arranged between coupler 3108 and support element 3060. A second radial bearing 3131 is arranged between drill bit 3048 and support element 3060, such as between coupler 3108 and support element 3060 axially spaced apart from first radial bearing 3130. At this point, it should be understood that the term "radial bearing" describes a bearing that supports angular rotation and axial movement while at the same time limit radial movement. The term "axial bearing" describes a bearing that supports angular rotation and radial movement while at the same time limits axial movement. It should also be understood that the number and position of bearings between drill bit 3048 and support element 3060 along vibration isolation device 3050 3064 may vary. Further, one or more axial load transferring elements, such as axial bearings or thrust bearings 3134 may be arranged between support element 3060 and drill bit 3048 such as between coupler 3108 and support element 3060. Bearings, such as axial bearings 3134 or radial bearings 3130, 3131, may comprising coatings or inserts such as diamond inserts (e.g., polycrystalline diamond compact (PDC) inserts) that protect bearing parts from damage or wear. The bearings may be ball bearings, thrust ball bearings, or roller bearings. Bearings may be installed in a bearing seat (not shown) that is movable with respect to support element 3060. For example, bearings may be installed in a bearing seat that is pivotable with respect to support element 3060. In the arrangement of FIG. 25, the mud will partially flow through radial bearings 3131 and 3130 and/or one or more axial bearings 3134, for cooling and lubrication purposes.

In accordance with an exemplary aspect, differential movement between support element 3060 and torsional flexible element 3064 dissipates energy through friction thereby dampening modal deformation. That is, energy that may be imparted to support element 3060 and/or torsional flexible element 3064 is dampened through frictional forces. More specifically, radial bearings 3130, 3131, and/or one or more axial bearings 3134 may define a friction damper (not separately labeled). In addition, to bearings 3130, 3131, and 3134, separate damping elements (not shown) may be included in the vibration isolation device 3050 such as damping elements discussed and disclosed with respect to FIGS. 1-22.

It should be understood that an adjustment device 3200 may be connected to first radial bearing 3130, second radial bearing 3131 and/or one or more axial bearings 3134. Adjustment device 3200 may selectively adjust frictional forces in first radial bearing 3130 and/or second radial bearing 3131 as well as in one or more axial bearings 3134. Adjustment device 3200 may include passive devices such as springs, and or active devices such as actuators, controlled dampers and the like. A measurement device 3210 may be employed to measure an amount of damping. Measurement device 3210 may be connected to adjustment device 3200 through a controller 3220. Controller 3220 may control an amount of damping provided through adjustment device 3200 based on parameters sensed by measurement device 3210 or as sensed by other BHA components.

During the drilling process, support element 3060 may be rotated by a rotating device (not shown) which may be part of the BHA 3044 (e.g., by a drilling motor) or located at the surface as part of the first system 3014 (e.g., by a so called top drive located at the earth's surface). The torque of rotating support element 3060 is transferred to the drill bit 3048 via torsional flexible element 3064, shaft 3094 and coupler 3108. By rotating drill bit 3048, drill bit 3048 interacts with formation 3036 that may in turn create torsional oscillations at the drill bit 3048 which will overlay the rotation of drill bit 3048 by rotating support element 3060. The torsional oscillations may be transferred through the various components of second system 3018 depending on their mass, moment of inertia, spring constant, or flexibility per unit length.

For example, the amount of torsional oscillations that is transferred through shaft 3094 is lower than through another component of second system 3018 if the flexibility per unit length of shaft 3094 is higher than the flexibility per unit length of the other component of second system 3018. In addition, the amount of torsional oscillations that is transferred through bearings such as radial bearings 3130, 3131, or one or more axial bearings 3134 is also very low compared to other components of the second system 3018. Hence, by the configuration shown in FIGS. 24 and 25, the drill bit 3048 will be rotated by transferring torque through vibration isolation device 3050, while at the same time the transfer of torsional oscillations through vibration isolation device 3050 is suppressed. This requirement has implications on the material and/or shape selection for the torsional flexible element 3064. The material and shape needs to be selected to ensure that torsional flexible element 3064 is able to withstand the torque that is to be transferred to the drill bit 3048 while at the same time has enough flexibility and low enough moment of inertia to effectively damp or isolate the torsional vibrations that are overlaying the rotation of drill bit 3048. As this is a tradeoff that is difficult to achieve with available materials, loads different from torque may be transferred by elements other than torque transferring torsional flexible element 3064 or shaft 3094.

For example, in an exemplary embodiment, torsional flexible element 3064 or shaft 3094 transfer torque as well as axial load from and to the drill bit 3048. In another exemplary embodiment, torsional flexible element 3064 or shaft 3094 may only transfer torque from and to the drill bit 3048 and other loads, such as axial loads and/or bending (e.g., cyclic bending), may be transferred by one or more axial bearings 3134 and/or radial bearings 3130, 3131, respectively. In another exemplary embodiment, support element 3060 transfers bending moment and axial loads partially via radial bearings 3130, 3131 and one or more axial bearings 3134 from and to drill bit 3048. By utilizing axial bearing 3134 and radial bearings 3131, 3130 below the second end section 3096 of shaft 3094, support element 3060 and drill bit 3048 are rotationally decoupled for small torsional deflections or oscillations. In other words, at least a part of the torque and torsional oscillations are transferred between drill bit 3048 and support element 3060 via torsional flexible element 3064 and shaft 3094. Thus, in one non-limiting embodiment, torsional flexible element 3064 or shaft 3094 transfer 30% or more of the torque from and to the drill bit 3048.

For example, in one non-limiting embodiment, torsional flexible element 3064 or shaft 3094 transfer 60% or more of the torque from and to the drill bit 3048. For example, in one non-limiting embodiment, torsional flexible element 3064 or shaft 3094 transfer 90% or more of the torque from and to the drill bit 3048. In a similar way, axial bearing 3134 may transfer 30% or more of the axial load from and to the drill bit 3048. For example, axial bearing 3134 may transfer 60% or more of the axial load from and to the drill bit 3048. For example, axial bearing 3134 may transfer 90% or more of the axial load from and to the drill bit 3048.

It should be understood that comparably large deflections may take place at the torsional flexible element 3064. Looking further into FIGS. 24 and 25, it should be understood, that differential angular displacement may be transferred into the radial bearings 3130, 3131 and one or more axial bearings 3134 via the torsional decoupled support element 3060. Support element 3060 is not observing modal displacement, while the inner components, mainly the flexible element, are subjected to relatively large modal angular displacements. Radial bearing elements 3130, 3131 and one or more axial bearing 3134 have respective sides connected to support element 3060 and to coupler 3108 respectively. Support element 3060 and drill bit 3048 therefore have relative movement according to the differential modal deformation between inner and outer components. The differential movement at the bearing elements dissipates energy through friction and therefore dampens the modal deformation. The friction force in the bearings can be adjusted e.g., by springs or other (passive or even active devices) to adjust the damping accordingly.

Figure 26:
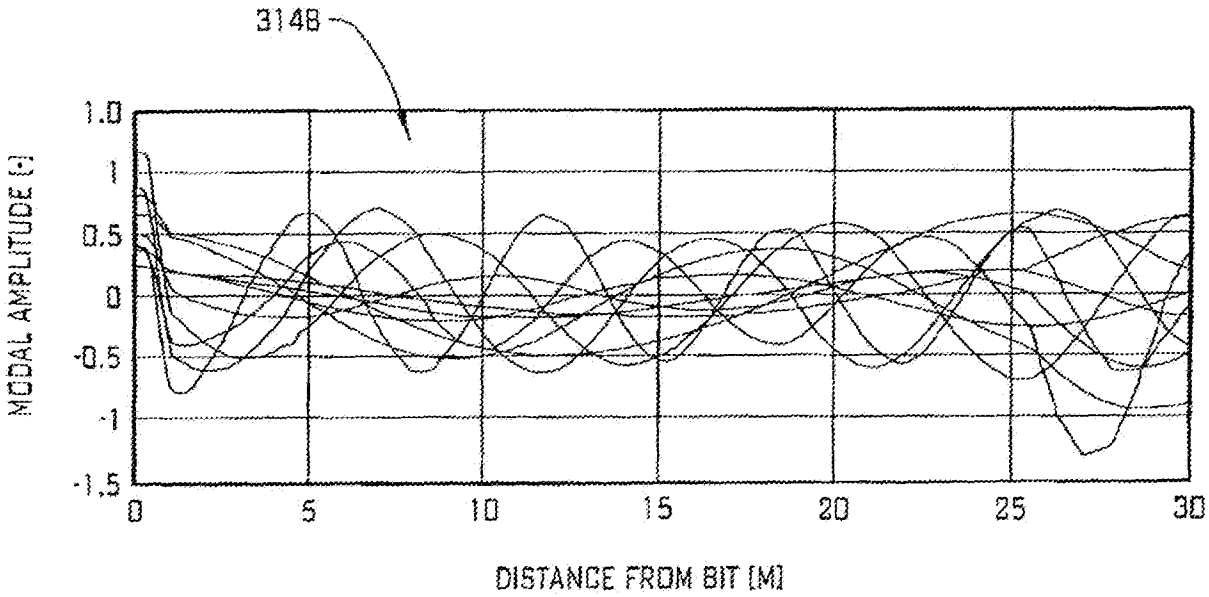
FIG. 26 depicts a graph illustrating vibrations passing from a bottom hole assembly without the vibration isolation device in accordance with an exemplary embodiment.
Figure 27:
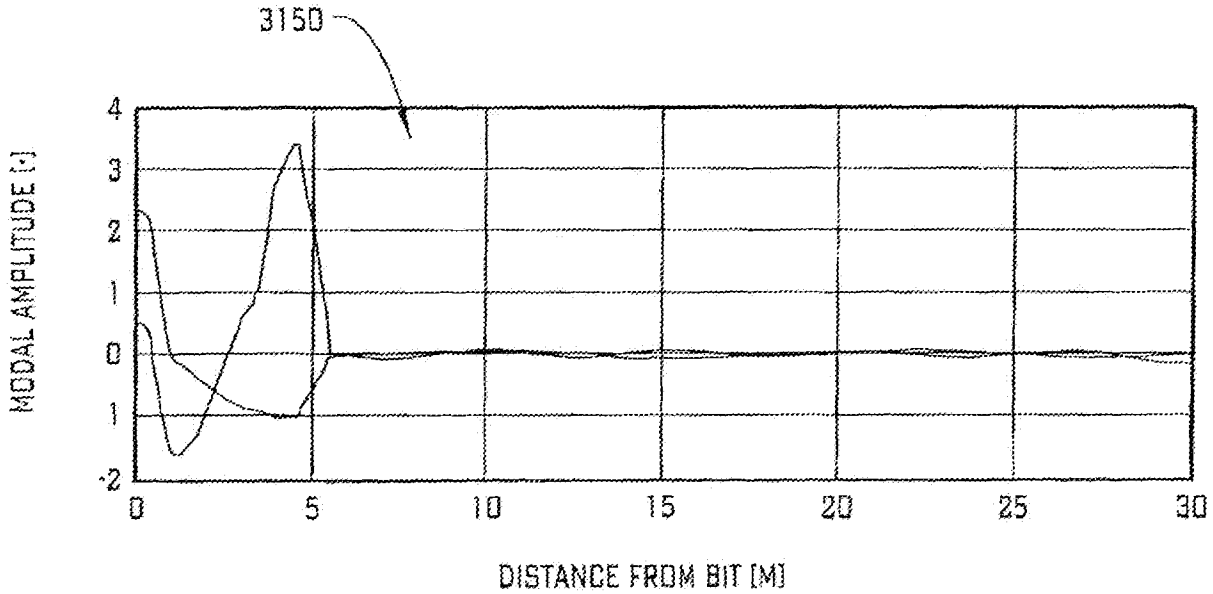
FIG. 27 depicts a graph illustrating vibrations passing from a bottom hole assembly with the vibration isolation device in accordance with an exemplary embodiment.

In accordance with an exemplary embodiment, vibration isolation device 3050 absorbs vibrations that may result from HFTO produced by drill hit 3048. That is, torsional flexible element 3064 may oscillate angularly relative to support element 3060 to isolate vibrations. Without the incorporation of vibration isolation device 3050 torsional vibrations may occur at multiple frequencies having multiple modes along BHA 3044 as shown at 3148 in FIG. 26. FIGS. 26 and 27 show both the modal torsional amplitude of the vibration vs. the distance from the bit. FIG. 26 shows the mode shapes that might be excited with a certain likelihood.

As shown in FIG. 26, such mode shapes can have high amplitudes at locations where, for example sensors, electronics, hydraulics and other vibration sensitive devices are installed. Amplitudes can reach levels that are detrimental for this type of devices. With the incorporation of vibration isolation device 3050, vibrations are significantly reduced at distances beyond the distance from drill bit 3048 to vibration isolation device 3050 as shown at 3150 in FIG. 27. FIG. 27 shows mode shapes that may be excited with the same likelihood as the mode shapes shown in FIG. 27. FIG. 27 shows that the amplitudes above vibration isolation device 3050 are significantly lower than below vibration isolation device 3050. The reduction of amplitudes above vibration isolation device 3050 relative to below vibration isolation device 3050 depends on the combination of material parameters and geometrical parameters (such as shape or size) as discussed above.

For example, amplitudes above vibration isolation device 3050 may be 40% lower than below vibration isolation device 3050. For example, amplitudes above vibration isolation device 3050 may be 60% lower than below vibration isolation device 3050. For example, amplitudes above vibration isolation device 3050 may be 85% lower than below vibration isolation device 3050. By comparing FIG. 27 with FIG. 26 it is clear that a second system 3018 with a vibration isolation device 3050 decreases the number of modes and at the same time decreases the amplitude of the remaining mode shapes in the portion of second system 3018 that is connected to the first end portion 3068 of vibration isolation device 3050.

For example, a vibration isolation device can be described as an oscillator, such as a torsional oscillator with a spring constant, such as a torsional spring constant, which acts as a mechanical low pass filter comprising an isolation frequency or cut-off frequency. Frequencies above that cut-off frequency are partially or completely suppressed and therefore isolated from a portion of the BHA 3044. The cut-off frequency (as well as the so-called eigenfrequency or resonance frequency) is a function of the spring constant. The more flexible the torsional oscillator, the lower the cut off frequency. For a cylindrical vibration isolation device, the cut-off frequency also depends on the length and the diameter of the vibration isolation device. Typical cylindrical vibration isolation device may have a diameter of less than 15 cm depending on material and the tool size. For example, a typical cylindrical vibration isolation device may have a diameter of less than 15 cm in 9.5" tools and less than 8 cm in 4.75" tools. For example, a typical cylindrical vibration isolation device may have a diameter of less than 13 cm in 9.5" tools and less than 7 cm in 4.75" tools. Similar, typical lengths of a vibration isolation device may be above 0.75 m depending on the tool size. For example, typical lengths of a cylindrical vibration isolation device may be above 0.75 m in 4.75" tools and above 0.8 m in 9.5" tools. For example, typical lengths of a cylindrical vibration isolation device may be above 0.9 m in 4.75" tools and above 1.1 m in 9.5" tools.

As shown in FIG. 27, it should be understood that the torsional flexible element 3064 or shaft 3094, (which in the case of FIG. 27, is located approximately 5 meters from the bit), threes the mode shapes to have a high amplitude at the second end section 3096 and a low amplitude at a first end section 3095.

It should be understood that instead or in addition to the bearing elements other friction dampener components (not displayed) can be connected to the coupler 3108 and the support element 3060 in a similar fashion as the bearing elements, with the difference that those other components are not utilized as bearing elements but for friction damping purposes. Those friction dampener components can be sized in an optimum manner for dampening. The material of those friction dampener components can also be selected accordingly. Those additional friction dampener components also take advantage of the relatively high modal deformation.

In yet still further accordance with an exemplary embodiment, an electrical conduit, such as an electrical conductor 3137, wire, or cable may extend through vibration isolation device 3050 for transmission of electrical power and/or communication through vibration isolation device 3050. Electrical conductor 3137 may, for example, extend through support element 3060 and transition into torsional flexible element 3064 via shaft 3094. Electrical conductor 3137 may extend to a connector portion 3140 provided on coupler 3108. Connector portion 3140 may take the form of an electrical contact such as a contact ring, a sliding contact, an inductive connection, or a resonant electromagnetic coupling device 3142. It should be understood that other connector types are also possible. For example, connector portion 3140 may also take the form of a centrally positioned pin type connector. In accordance with an exemplary embodiment, vibration isolation device 3050 absorbs vibrations that may result from HFTO produced by drill bit 3048. That is, torsional flexible element 3064 may rotate angularly relative to support element 3060 to absorb vibrations. Without the incorporation of vibration isolation device 3050 vibrations may occur at multiple frequencies having multiple modes as shown at 3148 in FIG. 26. With the incorporation of vibration isolation device 3050, vibrations are reduced to 2 frequencies/nodes such as shown at 3150 in FIG. 27. FIGS. 26 and 27 show both the modal torsional amplitude of the vibration vs. the distance from the bit.

Figure 28:
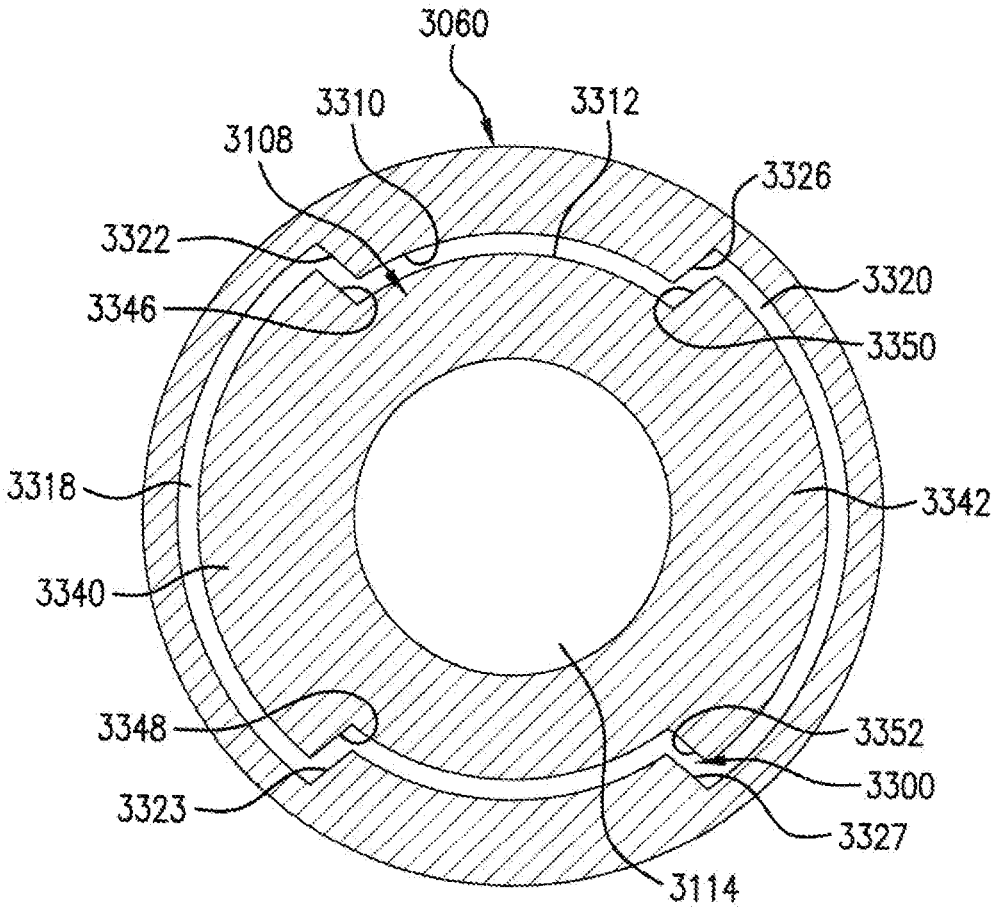
FIG. 28 depicts a cross-sectional end view of the vibration isolation device of FIG. 25 taken through the line 28-28, in accordance with an aspect of an exemplary embodiment.

Reference will now follow to FIG. 28, wherein like reference numbers represent corresponding parts in the respective views in describing an end stop mechanism 3300 that may form part of vibration isolation device 3050. FIG. 28 shows a cross section of vibration isolation device 3050 at a position that is indicated by line 28-28 in FIG. 25. In the exemplary aspect shown, support member 3060 includes an inner surface 3310 and coupler 3108 includes an outer surface 3312. A first recess 3318 is formed in inner surface 3310 of support member 3060. A second recess 3320 is formed in inner surface 3310 of support member 3060 opposite to first recess 3318. The number of recesses and the relative location of recesses may vary.

First recess 3318 includes a first stop surface 3322 and a second stop surface 3323. Second stop surface 3323 is spaced circumferentially relative to first stop surface 3322. Similarly, second recess 3320 includes a third stop surface 3326 and a fourth stop surface 3327. Fourth stop surface 3327 is spaced circumferentially from third stop surface 3326. First, second, third, and fourth stop surface extend radially outwardly of inner surface 3310.

In still further accordance with an exemplary aspect, coupler 3108 includes a first lobe section 3340 defined by, at least a portion of, outer surface 3312. Coupler 3108 also includes a second lobe section 3342 that is arranged opposite of first lobe section 3340. The number of lobe sections and the relative location of the lobe sections may vary. Typically, the number and location of the lobe sections would correspond to the number and orientation of the recesses formed in inner surface 3310.

First lobe section 3340 includes a first stop surface section 3346 and a second stop surface section 3348. First stop surface section 3346 is substantially complimentary of first stop surface 3322 and second stop surface section 3347 is substantially complimentary of second stop surface 3323. Second lobe section 3342 includes a third stop surface section 3350 and a fourth stop surface section 3352. Third stop surface section 3350 is substantially complimentary of third stop surface 3326 and fourth stop surface section 3352 is substantially complimentary of second stop surface 3327. With this arrangement, if for example, drill bit 3048 sticks for any reason, and support member 3060 is be rotated by a surface drive or drilling motor, torsional flexible element 3064 and shaft 3094 could be twisted which may lead to over torque and damage. Stop mechanism 3300 protects torsional flexible element 3064 and shaft 3094 from over torque that may be causes by a stuck or stalled drill bit. Stop mechanism 3300 mechanism may include spring elements or coatings (not shown) that protect the stop surfaces and/or stop surface sections.

Figure 29:
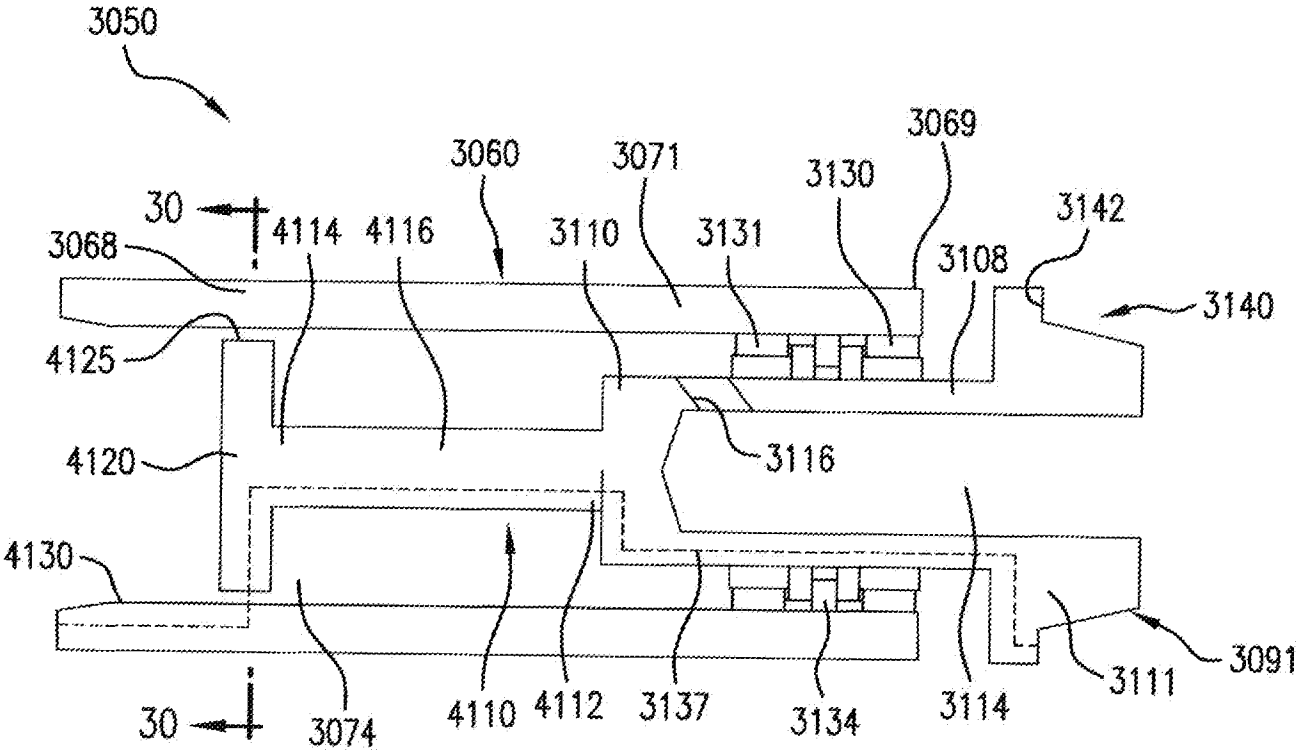
FIG. 29 depicts a schematic view of the vibration isolation device, in accordance with another aspect of an exemplary embodiment.
Figure 30:
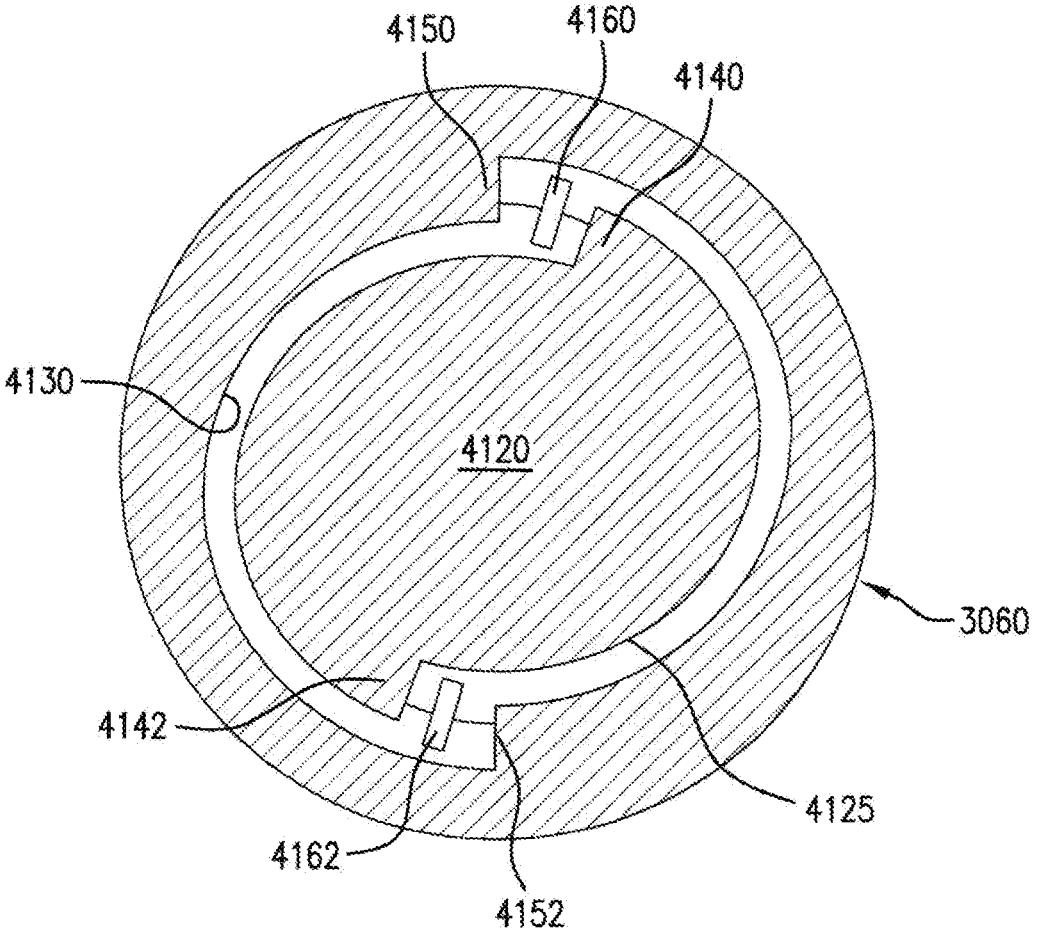
FIG. 30 depicts a cross-sectional end view of the vibration isolation device of FIG. 29 taken through the line 30-30, in accordance with an aspect of an exemplary embodiment.

Reference will now follow to FIGS. 29 and 30, wherein like reference numbers represent corresponding parts in the respective views. FIG. 30 shows a cross section of vibration isolation device 3050 at a position that is indicated by line 30-30 in FIG. 29. In the exemplary aspect shown, vibration isolation device 3050 may include a shaft 4110 extending from base portion 3110. Shaft 4110 includes a first end 4112 that extends from base portion 3110, a second end 4114, and an intermediate portion 4116 extending therebetween. Second end 4114 supports a hub 4120 having an outer surface 4125 that is spaced from an inner surface 4130 of support member 3060. As will be detailed herein, hub 4120 interfaces with support member 3060.

In accordance with an exemplary aspect, vibration isolation device 3050 includes an end stop mechanism that limits the relative rotation of hub 4120 with respect to support element 3060. For example, hub 4120 includes a first flange portion 4140 and a second, opposing flange portion 4142. Inner surface 4130 includes a first flange element 4150 and a second opposing flange element 4152. First flange element 4150 may be substantially complimentary of first flange 4140 and second flange element 4152 may be substantially complimentary of second flange 4142. A first spring element 4160 may be arranged between and connected with each of first flange 4140 and first flange element 4150. A second spring element 4162 may also be arranged between and connected with second flange element 4152. First and second spring elements 4160 and 4162 isolate torsional deflection of connector portion 3140 such as may result from vibrations caused by HFTO produced by drill bit 3048.

At this point it should be appreciated that the exemplary embodiments describe a vibration isolating device that isolates or substantially attenuates vibrations produced as a result of high frequency torsional vibrations of a bottom hole assembly (BHA) from other portions of a drill string. The vibration isolation device is designed to possess a torsional flexibility per unit length that is greater than a torsional flexibility of the BHA. In this manner, a torsional flexible element may angularly rotate relative to a support member as a result of torsional vibrations.

Set forth below are some embodiments of the foregoing disclosure.

Embodiment 1. A system for drilling a borehole into the earth's subsurface, the system comprising: a drill bit configured to rotate and penetrate through the earth's subsurface; and a vibration isolation device configured to isolate vibration that is caused at the drill bit, the vibration having an amplitude, wherein the amplitude of the vibration downhole of the vibration isolation device is at least 20% higher than the amplitude of the vibration uphole of the vibration isolation device.

Embodiment 2. The system according to any prior embodiment, wherein the vibration isolation device comprises: a support element configured to rotate the drill bit; and a torque transferring element configured to transfer torque from the support element to the drill bit and further configured to isolate torsional oscillations that are created at the drill bit from the support element.

Embodiment 3. The system according to any prior embodiment, wherein the amplitude of the vibration downhole of the vibration isolation device is at least 50% higher than the amplitude of the vibration uphole of the vibration isolation device.

Embodiment 4. The system according to any prior embodiment, wherein the amplitude of the vibration downhole of the vibration isolation device is at least 70% higher than the amplitude of the vibration uphole of the vibration isolation device.

Embodiment 5. The system according to any prior embodiment, further comprising a damping system configured to damp torsional oscillations in the torque transferring element.

Embodiment 6. The system according to any prior embodiment, wherein the damping system comprises: a first element; and a second element in frictional contact with the first element, wherein the second element moves relative to the first element with a velocity that is a sum of periodic torsional oscillations having an amplitude and a mean velocity, wherein the mean velocity is lower than the amplitude of the torsional oscillations.

Embodiment 7. The system according to any prior embodiment, wherein the damping system comprises: a first element; a second element in frictional contact with the first element; and an adjusting element arranged to adjust a force between the first element and the second element.

Embodiment 8. The system according to any prior embodiment, wherein the vibration isolation device further comprises: an end stop that limits rotational movement between the support element and the drill bit.

Embodiment 9. The system according to any prior embodiment, wherein the torque transferring element has a higher flexibility per unit length than the support element.

Embodiment 10. The system according to any prior embodiment, wherein the torque transferring element includes a torsional spring constant that is at least 10 times lower than a torsional spring constant of the support element.

Embodiment 11. The system according to any prior embodiment, further comprising: an electrical conduit providing power and/or communication from the support element and through at least a part of the torque transferring element.

Embodiment 12. A method for drilling a borehole into the earth's subsurface, the method comprising: rotating and penetrating a drill bit through the earth's subsurface; and isolating vibration that is caused at the drill bit by a vibration isolation device, the vibration having an amplitude, wherein the amplitude of the vibration downhole of the vibration isolation device is at least 20% higher than the amplitude of the vibration uphole of the vibration isolation device.

Embodiment 13. The method according to any prior embodiment, wherein the vibration isolation device comprises: a support element configured to rotate the drill bit; and a torque transferring element configured to transfer torque from the support element to the drill bit and further configured to isolate torsional oscillations that are created at the drill bit from the support element.

Embodiment 14. The method according to any prior embodiment, wherein the amplitude of the vibration downhole of the vibration isolation device is at least 50% higher than the amplitude of the vibration uphole of the vibration isolation device.

Embodiment 15. The method according to any prior embodiment, further comprising damping with a damping system torsional oscillations in the torque transferring element.

Embodiment 16. The method according to any prior embodiment, wherein the damping system comprises: a first element; and a second element in frictional contact with the first element, wherein the second element moves relative to the first element with a velocity that is a sum of periodic torsional oscillations having an amplitude and a mean velocity, wherein the mean velocity is lower than the amplitude of the torsional oscillations.

Embodiment 17. The method according to any prior embodiment, wherein the vibration isolation device further comprises: an end stop that limits rotational movement between the support element and the drill bit.

Embodiment 18. The method according to any prior embodiment, wherein the torque transferring element has a higher flexibility per unit length than the support element.

Embodiment 19. The method according to any prior embodiment, wherein the torque transferring element includes a torsional spring constant that is at least 10 times lower than a torsional spring constant of the support element.

Embodiment 20. The method according to any prior embodiment, wherein the vibration isolation device further comprises: an electrical conduit providing power and/or communication from the support element and through at least a part of the torque transferring element.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively, or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "above", "below", "up", "down", "upwards", "downwards" and similar referents in the context of describing the invention (especially in the context of the following claims) are to be construed to mean "closer to the drill bit"/"farther from the drill bit", respectively, along the second system 3018. The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A system for drilling a borehole into the earth's subsurface, the system comprising:

a drill bit configured to rotate and penetrate through the earth's subsurface; and a vibration isolation device configured to isolate vibration that is caused by an interaction with the earth's subsurface at the drill bit, the vibration having an amplitude, wherein the amplitude of the vibration downhole of the vibration isolation device is at least 20% higher than the amplitude of the vibration uphole of the vibration isolation device.

2. A system for drilling a borehole into the earth's subsurface, the system comprising:

a drill bit configured to rotate and penetrate through the earth's subsurface; and a vibration isolation device configured to isolate vibration that is caused at the drill bit, the vibration isolation device including a support element configured to rotate the drill bit; and a torque transferring element configured to transfer torque from the support element to the drill bit and further configured to isolate torsional oscillations that are created at the drill bit from the support element, the vibration caused at the drill bit having an amplitude, wherein the amplitude of the vibration downhole of the vibration isolation device is at least 20% higher than the amplitude of the vibration uphole of the vibration isolation device.

3. The system of claim 1, wherein the amplitude of the vibration downhole of the vibration isolation device is at least 50% higher than the amplitude of the vibration uphole of the vibration isolation device.

4. The system of claim 3, wherein the amplitude of the vibration downhole of the vibration isolation device is at least 70% higher than the amplitude of the vibration uphole of the vibration isolation device.

5. A system for drilling a borehole into the earth's subsurface, the system comprising:

a drill bit configured to rotate and penetrate through the earth's subsurface;

a support element configured to rotate the drill bit;

a torque transferring element configured to transfer torque from the support element to the drill bit and further configured to isolate torsional oscillations that are created at the drill bit from the support element;

a damping system configured to dampen the torsional oscillations in the torque transferring element; and a vibration isolation device configured to isolate vibration that is caused at the drill bit, the vibration having an amplitude, wherein the amplitude of the vibration downhole of the vibration isolation device is at least 20% higher than the amplitude of the vibration uphole of the vibration isolation device.

6. The system of claim 5, wherein the damping system comprises:

a first element; and a second element in frictional contact with the first element, wherein the second element moves relative to the first element with a velocity that is a sum of periodic torsional oscillations having an amplitude and a mean velocity, wherein the mean velocity is lower than the amplitude of the periodic torsional oscillations.

7. The system of claim 5, wherein the damping system comprises:

a first element;

a second element in frictional contact with the first element; and an adjusting element arranged to adjust a force between the first element and the second element.

8. The system of claim 2, wherein the vibration isolation device further comprises: an end stop that limits rotational movement between the support element and the drill bit.

9. The system of claim 2, wherein the torque transferring element has a higher flexibility per unit length than the support element.

10. The system of claim 2, wherein the torque transferring element includes a torsional spring constant that is at least 10 times lower than a torsional spring constant of the support element.

11. The system of claim 2, further comprising: an electrical conduit providing power and/or communication from the support element and through at least a part of the torque transferring element.

12. A method for drilling a borehole into the earth's subsurface, the method comprising:

rotating and penetrating a drill bit through the earth's subsurface; and isolating vibration that is caused at the drill bit interacting with the earth's subsurface by a vibration isolation device, the vibration having an amplitude, wherein the amplitude of the vibration downhole of the vibration isolation device is at least 20% higher than the amplitude of the vibration uphole of the vibration isolation device.

13. A method for drilling a borehole into the earth's subsurface, the method comprising:

rotating and penetrating a drill bit through the earth's subsurface; and isolating vibration that is caused at the drill bit with a vibration isolation device including a support element configured to rotate the drill bit; and a torque transferring element configured to transfer torque from the support element to the drill bit and further configured to isolate torsional oscillations that are created at the drill bit from the support element, wherein the vibration caused at the drill bit includes an amplitude, the amplitude of the vibration caused at the drill bit downhole of the vibration isolation device is at least 20% higher than the amplitude of the vibration uphole of the vibration isolation device.

14. The method of claim 12, wherein the amplitude of the vibration downhole of the vibration isolation device is at least 50% higher than the amplitude of the vibration uphole of the vibration isolation device.

15. A method for drilling a borehole into the earth's subsurface, the method comprising:

rotating and penetrating a drill bit through the earth's subsurface;

damping with a damping system torsional oscillations that are created at the drill bit in a torque transferring element; and isolating vibration that is caused at the drill bit with a vibration isolation device including a support element configured to rotate the drill bit, the vibration having an amplitude;

wherein the torque transferring element is configured to transfer torque from the support element to the drill bit and further configured to isolate the torsional oscillations from the support element, and wherein the amplitude of the vibration downhole of the vibration isolation device is at least 20% higher than the amplitude of the vibration uphole of the vibration isolation device.

16. The method of claim 15, wherein the damping system comprises:

a first element; and a second element in frictional contact with the first element, wherein the second element moves relative to the first element with a velocity that is a sum of periodic torsional oscillations having an amplitude and a mean velocity, wherein the mean velocity is lower than the amplitude of the periodic torsional oscillations.

17. The method of claim 13, wherein the vibration isolation device further comprises: an end stop that limits rotational movement between the support element and the drill bit.

18. The method of claim 13, wherein the torque transferring element has a higher flexibility per unit length than the support element.

19. The method of claim 13, wherein the torque transferring element includes a torsional spring constant that is at least 10 times lower than a torsional spring constant of the support element.

20. The method of claim 13, wherein the vibration isolation device further comprises: an electrical conduit providing power and/or communication from the support element and through at least a part of the torque transferring element.

* * * * *